US009440290B2

(12) United States Patent
Wong et al.

(10) Patent No.: US 9,440,290 B2
(45) Date of Patent: Sep. 13, 2016

(54) SURFACTANTLESS BIMETALLIC NANOSTRUCTURES AND METHOD FOR SYNTHESIZING SAME

(71) Applicant: The Research Foundation for The State University of New York, Albany, NY (US)

(72) Inventors: Stanislaus S. Wong, Stony Brook, NY (US); Christopher Koenigsmann, Mahopac, NY (US)

(73) Assignee: THE RESEARCH FOUNDATION FOR THE STATE UNIVERISITY OF NEW YORK, Albany, NY (US)

( * ) Notice: Subject to any disclaimer, the term of this patent is extended or adjusted under 35 U.S.C. 154(b) by 612 days.

(21) Appl. No.: 13/850,810

(22) Filed: Mar. 26, 2013

(65) Prior Publication Data

US 2014/0290436 A1 Oct. 2, 2014

(51) Int. Cl.
*B22F 9/24* (2006.01)
*B22F 1/00* (2006.01)

(52) U.S. Cl.
CPC ..... *B22F 9/24* (2013.01); *B22F 1/0003* (2013.01); *B22F 1/0025* (2013.01)

(58) Field of Classification Search
None
See application file for complete search history.

(56) References Cited

U.S. PATENT DOCUMENTS 7,147,834 B2 12/2006 Wong et al.
7,481,990 B2 1/2009 Wong et al.
7,575,735 B2 8/2009 Wong et al.
7,585,474 B2 9/2009 Wong et al.
2010/0278720 A1 11/2010 Wong et al.
2011/0174069 A1* 7/2011 Cornelius ..... B01J 19/0093 73/204.23
2011/0204321 A1* 8/2011 Choi ..... B82Y 10/00 257/9
2012/0219735 A1* 8/2012 Bakker ..... C23C 18/1648 428/34.1
2014/0065437 A1* 3/2014 Wong ..... B82Y 30/00 428/615

OTHER PUBLICATIONS

Patete et al., Viable methodologies for the synthesis of high-quality nanostructures, The Royal Society of Chemistry, Green Chem., 2011, 13, 482-519.
Koenigsmann et al., Size Dependent Enhancement of Electrocatalytic Performance in Relatively Defect-Free, Processed . . . , American Chemical Society NANO, 2010, 2806-2811.
Zhou et al., Enhanced Electrocatalytic Performance of One-Dimensional Metal Nanowires and Arrays . . . , American Chemical Society, J. Phys. Chem. C 2009, 113, 5460-5466.
Huang et al., One-Pot, High-Yield Synthesis of 5-Fold Twinned Pd Nanowires and Nanorods, American Chemical Society, J. Am. Chem. Soc. 2009, 131, 4602-4603.
Kline et al., Template-Grown Metal Nanowires, Inorganic Chemistry, vol. 45, No. 19, 2006, 7555-7565.
(Continued)

*Primary Examiner* — George Wyszomierski
(74) *Attorney, Agent, or Firm* — Hoffmann & Baron, LLP

(57) ABSTRACT

A bimetallic nanowire synthesis method is provided. The method includes adding first and second solutions into a vessel containing a porous template with the first solution containing first and second reagents added on one side of the porous template and the second solution added on an opposite side of the porous template. The first reagent includes a first salt of at least one of a transition metal, an actinide metal and a lanthanide metal. The second reagent includes a second salt of at least one of a transition metal, an actinide metal and a lanthanide metal. The second solution contains a reducing agent.

7 Claims, 38 Drawing Sheets

(56) References Cited

OTHER PUBLICATIONS

Tiano et al., Solution-Based Synthetic Strategies for One-Dimensional Metal-Containing Nanostructures, Chem. Commun. 2010, 46, 8093-8130.
Koenigsmann et al., Highly Enhanced Electrocatalytic Oxygen Reduction Performance Observed in Bimetallic . . . , American Chemical Society, Nano Lett. 2012, 12, 2013-2020.
Koenigsmann et al., Ambient Surfactantless Synthesis, Growth Mechanism, and Size Dependent . . . , American Chemical Society NANO, 2011, pp. 7471-7487, vol. 5, No. 9.
Wong et al., One-dimensional noble metal electrocatalysts: a promising structural paradigm for . . . , The Royal Society of Chemistry, Energy Environ. Sci., 2011, 4, 1161-1176.
Chen et al., Supportless Pt and PtPd Nanotubes as Electrocatalysts for Oxygen-Reduction Reactions, Angew. Chem. Int. Ed. 2007, 46, 4060-4063.
Xiong et al., Shape-Controlled Synthesis of Metal Nanostructures: The Case of Palladium, Wiley-VCH Verlag GmbH & Co. KGaA, Weinheim, Adv. Mater. 2007, 19, 3385-3391.
Wang et al., Pd Nanowire Arrays as Electrocatalysts for Ethanol Electrooxidation, Elsevier B.V., Electrochemical Communications 2007, 9, 1212-1216.
Sun, et al., Controlled Growth of Pt Nanowires on Carbon Nanospheres and Their Enhanced . . . , Wiley-VCH Verlag GmbH & Co. KgaA, Weinheim, Advanced Materials, 2008, 20, 3900-3904.
Shen et al., Preparation of single-crystalline platinum nanowires with small diameters under mild . . . , The Royal Society of Chemistry, Chem. Commun., 2007, pp. 245-247.
Koenigsmann et al., Enhanced Electrocatalytic Performance of Processed, Ultrathin, Supported Pd-Pt . . . , American Chemical Society, J. Am. Chem. Soc., 2011, 133, pp. 9783-9795.

* cited by examiner

SURFACTANTLESS BIMETALLIC NANOSTRUCTURES AND METHOD FOR SYNTHESIZING SAME

BACKGROUND OF THE INVENTION

1. Field of the Invention

The present invention relates generally to nanotechnology and, more particularly, to a method for synthesizing bimetallic nanostructures.

2. Description of the Related Art

One-dimensional (1-D) metallic nanostructures provide unique structure-dependent optical, electrical and thermal properties. In addition, metallic nanostructures are effective electrocatalysts for Oxygen Reduction Reactions (ORR) and alcohol electro-oxidation reactions in Polymer Electrolyte Membrane Fuel Cells (PEMFCs). Conventional PEMFCs, such as nanoparticulate platinum based catalysts, suffer from low efficiencies as well as high cost. Low efficiency of PEMFCs arises from slow oxygen reduction kinetics, resulting in cathodic overpotential. Platinum nanoparticle catalysts possess a relatively high number of defect sites and low-coordination atoms at their surface as a result of a zero-dimensional (0-D) structure, which renders the platinum nanoparticles less active toward ORR and necessitates high loadings in a range of 0.15 to 0.25 mg/cm$^2$ to achieve practical efficiencies.

Koenigsmann et al., in *Size-Dependent Enhancement of Electro catalytic Performance in Relatively Defect-Free, Processed Ultrathin Platinum Nanowires*, Nano. Lett. 2010, 10, 2806-2811, investigate size dependence of 1-D platinum nanostructures on activity, comparing relevant activity of nanotubes with diameters of 200 nm to that of 1 nm diameter platinum nanowires. Electrochemically determined specific activities for ORR indicate a nearly 4-fold increase in specific activity from 0.38 to 1.45 mA/cm$^2$ as the 1-D platinum nanostructure diameter decreases from 200 nm to 1.3 nm. This size-dependent increase in activity of 1-D nanostructures, as the diameter decreases from the submicrometer range, i.e., 100 nm<diameter<1 μm, to the nanometer range, i.e. diameter<100 nm, contrasts with that of 0-D carbon supported platinum nanoparticles. In 0-D carbon supported platinum nanoparticle catalysts, activity decreases significantly as particle size decreases from the submicrometer to nanometer sizes, particularly when particle size decreases below 5 nm. Nanometer-sized platinum 1-D catalysts activity is observed to arise from contraction of the platinum nanostructure surface. The small diameter of the nanometer platinum nanowire catalysts minimizes precious metal wasted in the core of the nanowire, while also providing increased electrochemical activity.

Nevertheless, a continuing challenge in exploration of size-dependent trends with 1-D nanostructures is the development of environmentally friendly methods for synthesis of crystalline, high purity nanostructures with high aspect ratios and predictable dimensions. Many solution-based methods for preparing 1-D noble metal nanowires have been reviewed by Tiano et al., in *Solution-Based Synthetic Strategies for One-Dimensional Metal-Containing Nanostructures*, Chem. Comm. 2010, 46, 8093-8130. For example, Xia et al., in *Shape-Controlled Synthesis of Metal Nanostructures: The Case of Palladium* Adv. Mater. 2007, 19, 3385-3391, provide methods utilizing elevated temperatures and pressures for preparation of anisotropic nanostructures of palladium such as nanorods, nanoplates, nanocubes, and twinned nanoparticles, where control of reaction kinetics with additives, such as inorganic salts and surfactants, yield nanostructures with predictable morphology. Zheng et al., in *One-Pot, High-Yield Synthesis of 5-Fold Twinned Pd Nanowires and Nanorods*, J. Am. Chem. Soc. 2009, 131, 4602-4603, demonstrate generation of high-quality palladium nanowires and nanorods with diameters of 9.0 nm at elevated temperatures, employing poly(vinylpyrrolidone) as both a surfactant and as an in situ reducing agent.

Although the methods described above generate high quality 1-D nanostructures, a limitation of these synthetic methods is a lack of control over diameter and aspect ratio of the synthesized nanostructures. In addition, surfactant molecules serving as capping agents in these synthetic methods are adsorbed onto surfaces of the nanostructures. Surfactant adsorption limits application of the nanostructures as catalysts, sensors and electrocatalysts, since decreased exposure of the surfaces of the nanostructures inhibits activity.

In light of these limitations, porous template-based methods are employed in synthesis of 1-D nanostructures. Specifically, dimensions of pores within a porous template determine size and morphology of nanostructures grown within the porous template. Regarding template-based synthesis of nanostructured metals, Wang et al., in *Pd Nanowire Arrays as Electrocatalysts for Ethanol Electrooxidation* Electrochem. Comm. 2007, 9, 1212-1216, provide a method for obtaining 1-D nanostructures through electro-deposition of precursors within either Polycarbonate (PC) or Anodic Alumina Oxide (AAO) porous templates. For example, arrays of palladium nanostructures with uniform diameters of 80 nm were prepared by Wang et al. through electro-deposition within an AAO template having pore sizes of 80 nm. However, the electro-deposition method described by Wang et al. requires additional electrochemical equipment and uses caustic reaction media. Kline et al., in *Template-Grown Metal Nanowires*, Inorg. Chem. 2006, 45, 7555-7565, describe conventional electro-deposition methods requiring physical vapor deposition techniques to deposit a conductive metallic backing onto porous templates prior to nanostructure deposition. Collectively, these processes are costly, inefficient, and difficult to scale up.

Patete et al., in *Viable Methodologies for the Synthesis of High-Quality Nanostructures*, Green Chem. 2011, 13, 482-519, describe use of a U-tube double diffusion vessel as both an effective and green method for the production of high-quality 1-D metallic nanostructures under ambient conditions. U.S. Pat. No. 7,575,735 to Wong et al., which is incorporated herein by reference, utilizes a U-tube double diffusion vessel in synthesis of metal oxide and metal fluoride nanostructures. Further, U.S. Patent Publication No. 2010/0278720 A1 to Wong et al., which is incorporated herein by reference, utilizes the U-tube double diffusion vessel to synthesize metal oxide nanostructures. The U-tube methods of Patete et al. and Wong et al. provide metal oxide and metal fluoride nanowires by precipitation of a metal cation with an appropriate anion, i.e., $OH^-$ or $F^-$, for growth of the nanowire. However, Patete et al. and Wong et al. do not provide a method to prepare nanowires composed of metal only without other non-metal components, since two separate reagents must react to form the nanowire. Another shortcoming of Patete et al. and Wong et al. is that the metal component within the metal oxide or metal fluoride nanowire maintains a cationic state and is not fully reduced, which reduces catalytic performance of the nanowire, particularly towards ORR. Conventional methods fail to disclose formation of metallic nanowires without non-metal components under ambient, surfactantless conditions.

SUMMARY OF THE INVENTION

The method of the present invention overcomes the above shortcomings of conventional methods and systems by providing surfactantless and electroless methods for bimetallic nanowire synthesis under environmentally benign conditions, to provide a bimetallic nanowire, and method for synthesis thereof, produced by adding first and second solutions into a vessel containing a porous template with the first solution containing first and second reagents added on one side of the porous template and the second solution added on an opposite side of the porous template. The first reagent includes a first salt of at least one of a transition metal, an actinide metal and a lanthanide metal. The second reagent includes a second salt of at least one of a transition metal, an actinide metal and a lanthanide metal. The second solution contains a reducing agent.

BRIEF DESCRIPTION OF THE DRAWINGS

The above and other aspects, features and advantages of certain embodiments of the present invention will be more apparent from the following detailed description taken in conjunction with the accompanying drawings, in which.

DETAILED DESCRIPTION OF EMBODIMENTS OF THE PRESENT INVENTION

The following detailed description of certain embodiments of the present invention will be made in reference to the accompanying drawings. In describing the invention, explanation about related functions or constructions known in the art are omitted for the sake of clearness in understanding the concept of the invention, to avoid obscuring the invention with unnecessary detail.

A method for synthesizing a bimetallic nanostructure, i.e., a bimetallic nanowire, and compositions derived from such method, is provided. Specifically, the method provides a synthesis of bimetallic nanowires avoiding use of surfactants, electrochemical equipment, toxic reaction media, and physical vapor deposition techniques. Further, the method utilizes environmentally friendly solvents, such as alcohols or water, and is performed under ambient conditions. The method employs a U-tube double diffusion vessel to prepare high-quality, single crystalline, bimetallic nanowires. Diameter of the bimetallic nanowires is controlled and ranges from 1 nm to 1 μm. The nanowires are substantially free of non-metallic impurities, such oxides, halides, sulfides, phosphides, or nitrides, and organic contaminants, such as capping agents, surface ligands or surfactants without additional purification steps.

Figure 1:
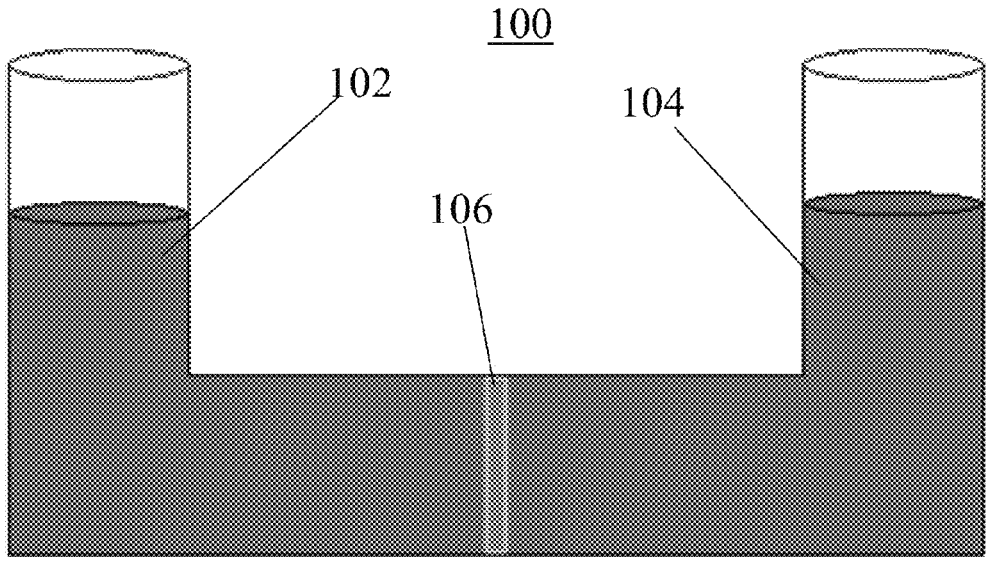
FIG. 1 illustrates a U-tube double diffusion vessel employed to synthesize nanowires, according to an embodiment of the present invention.

FIG. 1 illustrates a U-tube double diffusion vessel employed in synthesizing a bimetallic nanowire, according to an embodiment of the present invention. Synthesis of bimetallic nanowires is achieved by addition of a first solution 102 including a first metal reagent and a second metal reagent, i.e. metal precursors, such as metal salts, and a second solution 104 including a reducing agent into first and second half-cells, respectively, of a U-tube double diffusion vessel 100. The metal reagents and the reducing agent co-diffuse into pores of a porous template 106. The porous template provides a 1-D reaction chamber that confines nucleation and growth of the nanowires. The pores of the porous template 106 direct nucleation, i.e. initial formation, and nanowire growth.

According to an embodiment of the present invention described herein, the method utilizes the U-tube double diffusion vessel 100 to provide control over properties of the bimetallic nanowire. A diameter of the bimetallic nanowire is determined by a diameter of the pores of the porous template 106. Bimetallic nanowire length is controlled by one of a concentration of the metal reagents, a concentration of the reducing reagent and the reaction time. The length of the bimetallic nanowire is limited by a length of the pores of the porous template 106. Elemental composition of the bimetallic nanowire is determined by selection of the metal reagents added to the first solution 102.

Figure 2:
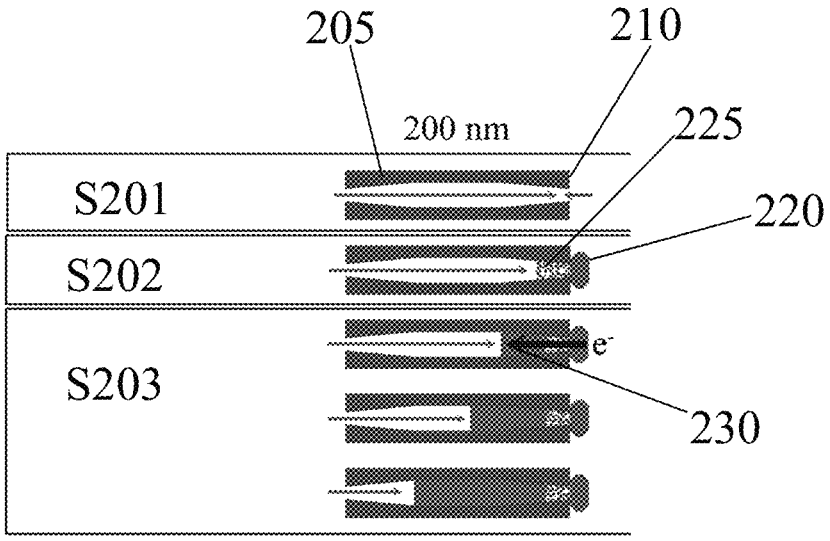
FIGS. 2-3 are porous template schematics showing steps of growth of nanowires, according to an embodiment of the present invention.

FIG. 2 is a schematic illustrating nanowire growth within a single pore, according to an embodiment of the present invention. As shown in FIG. 2, a porous template having 200 nm pores is provided, and steps S201-S203 illustrate a growth mechanism for nanowire synthesis within the porous template.

In step S201 of FIG. 2, the first solution, including the first and second metal reagents, and the second solution, including the reducing agent, diffuse into pore 205 of the porous template 106, with such diffusion illustrated by the opposing arrows. In step S202, the metal reagents are reduced by the reducing agent and nucleation of a bimetallic nanowire begins. For 200 nm template pores, nucleation of the bimetallic nanowire occurs at an interface of the pores and the second solution on an external surface 210 of the porous template. Nucleation begins with formation of a metallic surface 220 on the external surface 210 of the porous template and followed by formation of a polycrystalline segment 225 of the bimetallic nanowire within the template pore 205. A length of the polycrystalline segment is generally less than 1 μm. Formation of the metallic surface 220 on the external surface 210 of the porous template is observed visually within a minute of addition of the first and second solutions to the U-tube vessel. The formation of the polycrystalline segment 225 in step S202 ends when the polycrystalline segment 225 and the metallic surface 220 create a barrier between the second solution and the pore 205 and prevent diffusion of the second solution into the pore.

In step S203, a single crystalline segment 230 of the bimetallic nanowire forms on, and grows from, the polycrystalline segment 225 of the bimetallic nanowire within the pore 205 through an electroless deposition process. Specifically, electrons (e) transfer through the metallic surface 220 and the polycrystalline segment 225, reducing the first and second metal reagents inside of the template pore 205. It is believed that transferred electrons, and not direct interaction with the reducing agent, reduce the first and second metal reagents to form the single crystalline segment 230 of the bimetallic nanowire, whereas the polycrystalline segment 225 is believed to form as a result of direct interaction with, and reduction by, the reducing agent. Formation of the single crystalline segment of the bimetallic nanowire extends into the pore 205 of the porous template towards the first solution. Completion of the reaction in step S203 is visually observed by formation of a metallic layer on the surface of the template exposed to the first solution, which confirms that the bimetallic nanowires have filled the template pore 205.

Figure 3:
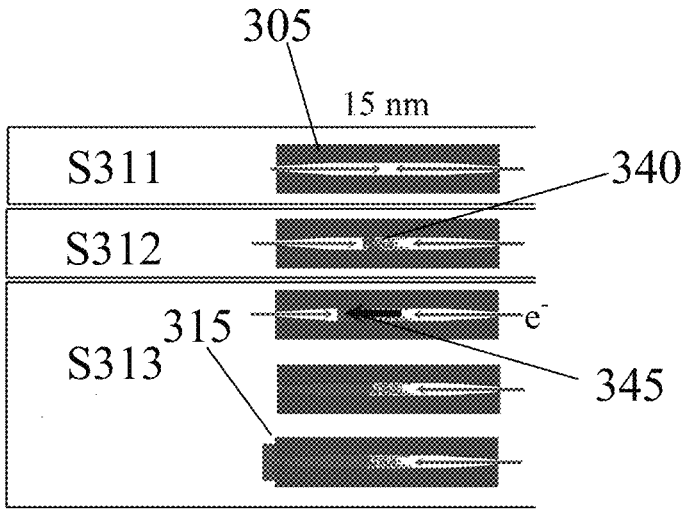

FIG. 3 is a schematic illustrating a porous template having 15 nm pores, according to an embodiment of the present invention. As shown in FIG. 3, steps S311-S313 illustrate a growth mechanism for bimetallic nanowire synthesis within the porous template.

In step S311, the first solution, including the first and second metal reagents, and the second solution, including the reducing agent, diffuse into pores 305 of the porous template, with such diffusion illustrated by the opposing arrows. In step S312, the first and second metal reagents are reduced by the reducing agent and nucleation of a bimetallic nanowire begins. For 15 nm template pores, nucleation of the bimetallic nanowire occurs in a central region of the template pore 305 where the first and second solutions interact directly by diffusion. Nucleation of the bimetallic nanowire begins with formation of a polycrystalline segment 340 within an interior of the pore 305. Formation of the polycrystalline segment 340 in step S312 ends when the polycrystalline segment 340 creates a physical barrier between the first and second solutions and prevents diffusion of the second solution into the pore 305.

In step S313, a single crystalline segment 345 of the bimetallic nanowire forms on the polycrystalline segment 340 within the pore 305 through electroless deposition. Specifically, electrons (e) transfer through the polycrystalline segment 340 when a diameter of the polycrystalline segment equals a diameter of the pore 305 of the porous template. Therefore, the transferred electrons, and not direct interaction with the reducing agent, reduce the first and second metal reagents to form the single crystalline segment 345, whereas the polycrystalline segment 340 is believed to form as a result of direct interaction with, and reduction by, the reducing agent. Formation of the single crystalline segment 345 of the bimetallic nanowire extends into the pore 305 towards the first solution. Formation of a metallic surface on an external surface 315 of the porous template within the first solution is observed visually, indicating completion of the bimetallic nanowire synthesis.

Figure 4:
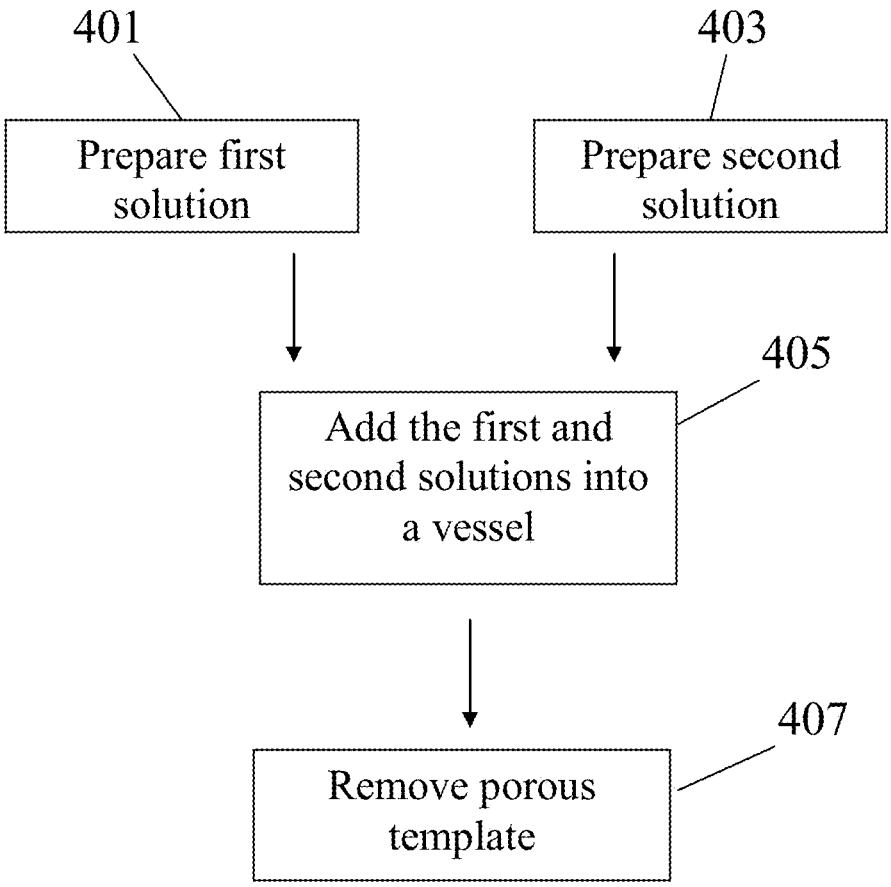
FIG. 4 is a flowchart of a bimetallic nanowire synthesis method, according to an embodiment of the present invention.

FIG. 4 is a flowchart of a nanowire synthesis method, according to an embodiment of the present invention. In steps 401 and 403, first and second solutions, respectively, are prepared. In step 405, the first and second solutions are added into a vessel, such as the U-tube double diffusion vessel of FIG. 1, containing a porous template 106. The first solution is added on one side of the porous template and the second solution added on an opposite side of the porous template. The first solution contains a first metal reagent and a second metal reagent. The first and second metal reagents include first and second salts, respectively, of at least one of a transition metal, a lanthanide metal, and an actinide metal and mixtures thereof. The second solution contains a reducing agent.

Reduction of the first and second metal reagents may occur at any position within the template pore, as described with respect to FIGS. 2-3. The bimetallic nanowire synthesis proceeds for a predetermined amount of time, preferably between 1 second and 24 hours, and may proceed longer than 24 hours to fill the pores of the porous template. The bimetallic nanowire synthesis yields an alloy of the metal of the first salt and of the metal of the second salt. The bimetallic nanowire has a stoichiometric composition described by the formula: $A_{1-x}B_x$, where A is the metal of the first salt, B is the metal of the second salt, and x is $0<x<1$.

The first solution and the second solution are provided in a solvent including at least one of water ($H_2O$) and an alcoholic solvent, and mixtures thereof. The bimetallic nanowire is synthesized with the solvent in a liquid state. Specifically, a temperature of the first solution and the second solution is above the melting point and below the boiling point of the solvent, and preferably at ambient conditions. However, heating of the first and second solutions during the bimetallic nanowire synthesis provides a more rapid formation of the bimetallic nanowires and promotes formation of polycrystalline nanowires. Additionally, cooling the first and second solutions during the nanowire synthesis slows the growth of the bimetallic nanowire and promotes formation of single crystalline nanowires.

In step 407, the porous template is removed from the vessel with the synthesized bimetallic nanowires contained therein. The bimetallic nanowires can be isolated as either a solid powder or as free-standing nanowire arrays.

The synthesized bimetallic nanowire includes at least two transition metals, such as palladium, gold, ruthenium, and platinum, and mixtures thereof. The bimetallic nanowire and surface thereof are substantially free of organic contaminants and impurities. Dimensions, i.e., diameter and length, of the bimetallic nanowire are defined by respective dimensions of the pore. Length of the bimetallic nanowire is also determined by concentration of the metal reagents in the first solution, concentration of the reducing agent in the second solution, and reaction time.

The first salt of the first metal reagent preferably includes a metal cation of the transition metal, actinide metal or the lanthanide metal, and mixtures thereof, with a corresponding anion including at least one of halides, oxides, acetates, acetyl-acetates, nitrates, phosphates, sulfates, sulfides, citrates, hydroxides, amine halides, amine hydroxides, hydrogen halides, alkali halides, ethylenediamine halides, hydrogen hydroxides, cyanides and carbonates, and mixtures thereof.

The second salt of the second metal reagent preferably includes a metal cation of the transition metal, actinide metal or the lanthanide metal, and mixtures thereof, with a corresponding anion including at least one of halides, oxides, acetates, acetyl-acetates, nitrates, phosphates, sulfates, sulfides, citrates, hydroxides, amine halides, amine hydroxides, hydrogen halides, alkali halides, ethylenediamine halides, hydrogen hydroxides, cyanides and carbonates, and mixtures thereof.

The reducing agent preferably includes at least one of metal borohydrides, sodium cyanoborohydride, metals (Na, Li, K, Rb, Cs, Mg, Ca, Al, Zn etc.), citric acid, citrate anion, ascorbic acid, ascorbate anion, formic acid, formate anion, oxalic acid, oxalate anion, lithium aluminum hydride, diborane, alpine borane, hydrogen gas, hydrazine, and 2-mercaptoethanol etc. High concentrations of the reducing agent in the second solution tend to promote formation of polycrystalline nanostructures, while low concentrations of the reducing agent tend to promote the formation of single crystalline nano structures.

Specific examples of preferred embodiments of synthesized bimetallic nanowires, i.e. nanowires composed of two metals, are provided below, utilizing the U-tube double diffusion vessel, as described with respect to FIGS. 1-4.

Examples

Synthesis of Bimetallic Nanowires

Utilizing the method described above, bimetallic nanowires according to the formula $A_{1-x}B_x$, where x is $0<x<1$, were synthesized. For example, nanowires of formulas $Pd_{1-x}Au_x$, and $Pd_{1-x}Pt_x$ including chemical compositions x=0.1, 0.25, 0.5, 0.75, and 0.9 are provided. Bimetallic nanowires synthesized according to the method display improvements in electrocatalytic activity and durability toward oxygen reduction. Specific examples of compounds synthesized according to the method were: $Pd_9Au$, $PdAu_3$, PdAu, $Pd_3Au$, $Pd_3Pt_7$, $PdPt_4$, PdPt, $PdPt_3$, $Pd_3Pt$, and $PdPt_9$.

Synthesis of the $A_{1-x}B_x$ nanowires utilized the u-tube double diffusion vessel as described above with respect to FIGS. 1 and 4. For example, stock solutions of a first reagent, such as sodium hexachloropalladate (87.5 mg $Na_2PdCl_6.xH_2O$, 99.9%), and a second reagent, such as hexachloroplatinic acid hydrate (102.5 mg $H_2PtCl_6.xH_2O$, 99.9%) or tetrachloroauric acid hydrate (64.0 mg $HAuCl_4$.xH2O, 99.999%), were prepared by dissolution in 5 mL of a solvent, such as water, ethanol, or absolute ethanol, and mixtures thereof. Concentrations of the stock solutions were optimized to achieve a correlation between the first and second reagents and a composition of the synthesized nanowires.

To achieve the desired nanowire composition of the formula $A_{1-x}B_x$, a first solution was prepared by combining aliquots of the first reagent stock solution and the second reagent stock solution in the appropriate stoichiometric volume fraction to generate a total of 5 mL of the first solution.

For example, a first solution having a volume of 5 mL was prepared using 3.75 mL of palladium stock solution and 1.25 mL of the gold stock solution in the synthesis of the $Pd_3Au$ nanowires. A second solution of a reducing agent, such as a 5 mM sodium borohydride solution ($NaBH_4$, Alfa Aesar 98%), was prepared by dissolution of the reducing agent into 5 mL of a solvent, such as water, ethanol, or absolute ethanol, and mixtures thereof, with brief sonication.

Prior to performing the reaction, commercially available porous template membranes (Whatman, Nucleopore—track etched), with pores having a diameter of 15 nm, were sonicated in ethanol to pre-saturate the pores.

The porous template was clamped between half-cells of the u-tube vessel and the half-cells were separately loaded with the first solution and the second solution. During the reaction, the first and second reagents in the first solution and the reducing agent diffused into pores of the porous template. After 30 minutes, the porous template was removed from the u-tube vessel and rinsed with ethanol to remove residual metals and reducing agent. The porous templates were processed to generate either isolated bimetallic nanowires or free-standing bimetallic nanowire arrays.

Individual isolated bimetallic nanowires were obtained by polishing off excess metallic material on external surfaces of the porous template, dissolving the porous template in methylene chloride, and separating by centrifugation. Repeating the washing and centrifugation steps several times is preferred for thorough purification.

Free standing bimetallic nanowire arrays were prepared by affixing the porous template onto a substrate, e.g. glass or silicon, and exposing the substrate to oxygen plasma etching for 20 minutes in a reactive ion etcher (March Plasma).

Reaction yield is dependent upon a diameter of the pores and pore density of the porous template employed. Estimates of yield for bimetallic nanowire synthesis are between 0.05 and 0.1 mg/cm$^2$ of the porous template. Higher yields may be achieved using porous templates with higher pore densities, such as anodic alumina.

Figure 5:
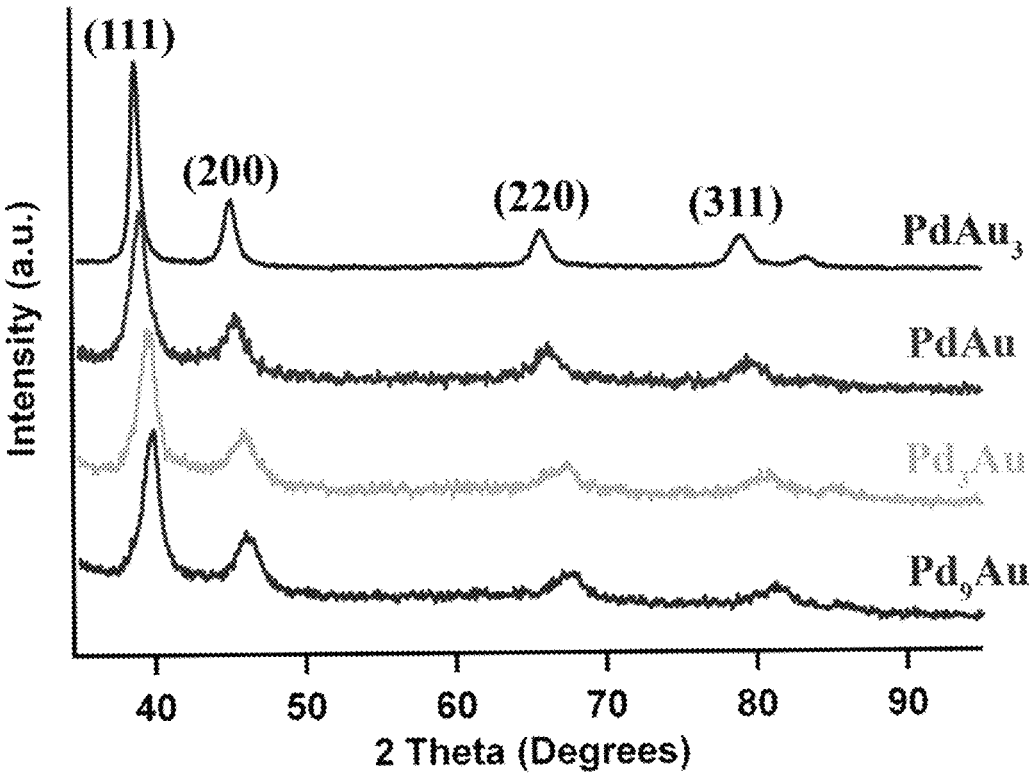
FIGS. 5-6 are powder X-Ray Diffraction (XRD) graphs of $A_{1-x}B_x$ nanowires, according to an embodiment of the present invention
Figure 6:
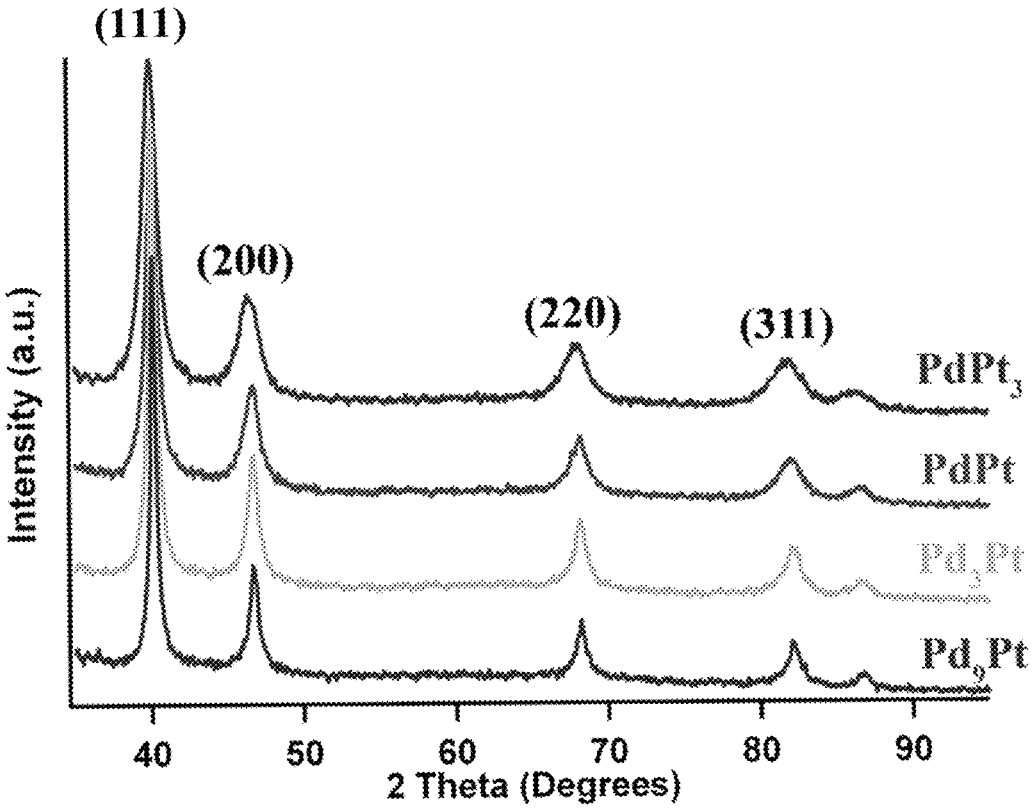

Characterization of Bimetallic Nanowires:

FIGS. 5-6 are powder X-Ray Diffraction (XRD) graphs of $A_{1-x}B_x$ nanowires, according to an embodiment of the present invention. FIG. 5 illustrates XRD graphs of $Pd_{1-x}Au_x$ bimetallic nanowires and FIG. 6 illustrates XRD graphs of $Pd_{1-x}Pt_x$ bimetallic nanowires, where x is $0.1<x<0.75$. FIGS. 5 and 6 confirm that the $A_{1-x}B_x$ bimetallic nanowires are homogeneous alloys with a face-centered cubic crystal structure. The absence of any other peaks in FIGS. 5 and 6 indicates that the bimetallic nanowires are substantially free of any impurities.

XRD patterns were obtained on dry powders of the bimetallic nanowires supported on glass with a Scintag diffractometer utilizing copper Kα radiation at a scan rate of 0.25 degrees in 20 per minute. XRD samples were prepared by creating an ethanolic slurry with the bimetallic nanowires and allowing to air dry.

Figure 7:
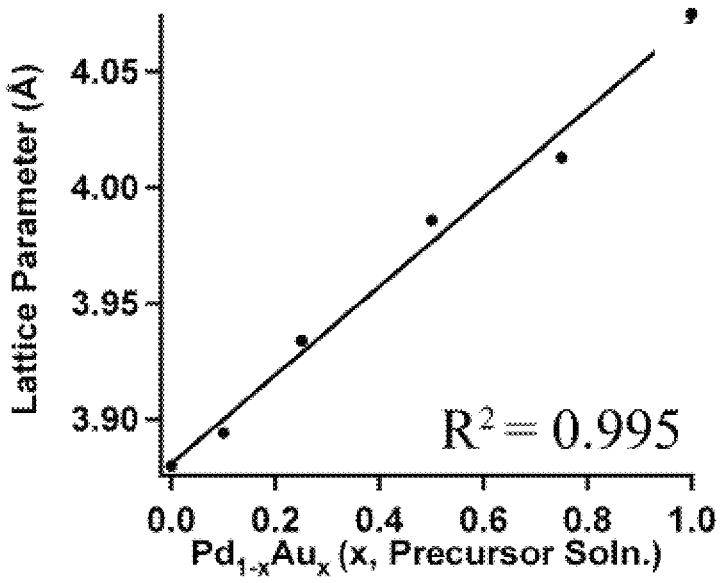
FIGS. 7-12 are graphs illustrating a relationship between measured lattice parameter and measured bimetallic nanowire composition, as a function of the concentration ratio of the first reagent and second reagent in the first solution for $A_{1-x}B_x$ nanowires, according to an embodiment of the present invention.
Figure 8:
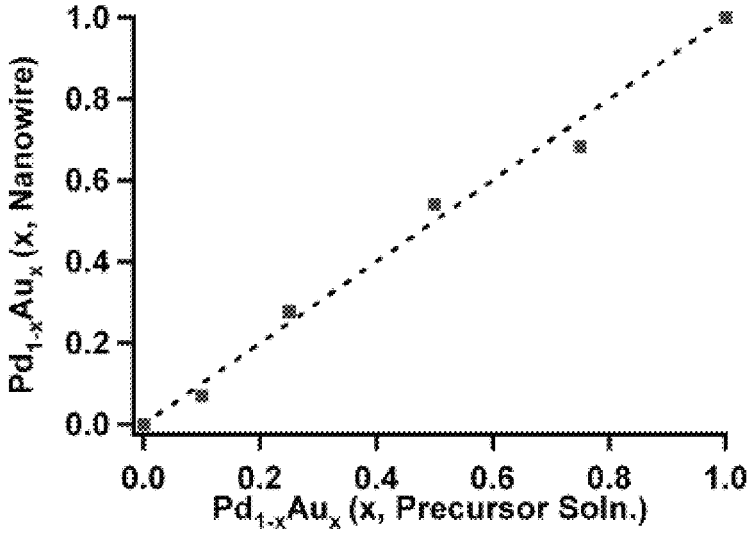
Figure 9:
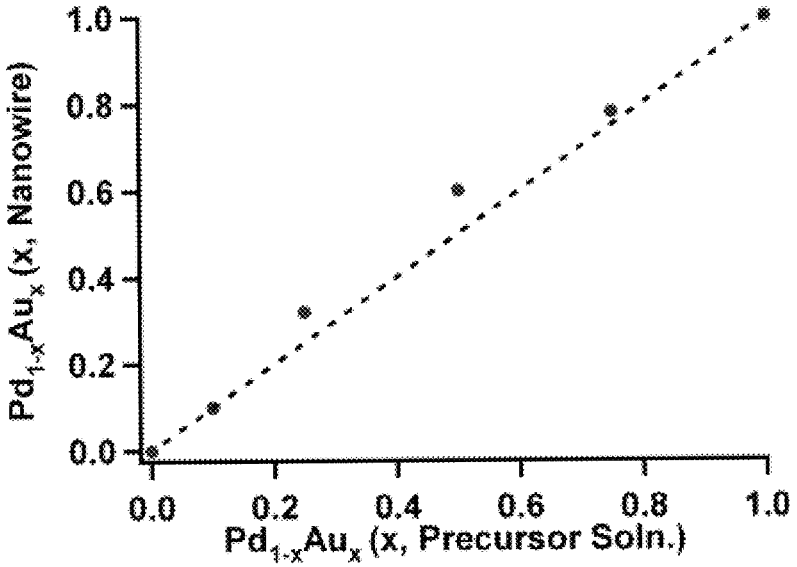
Figure 10:
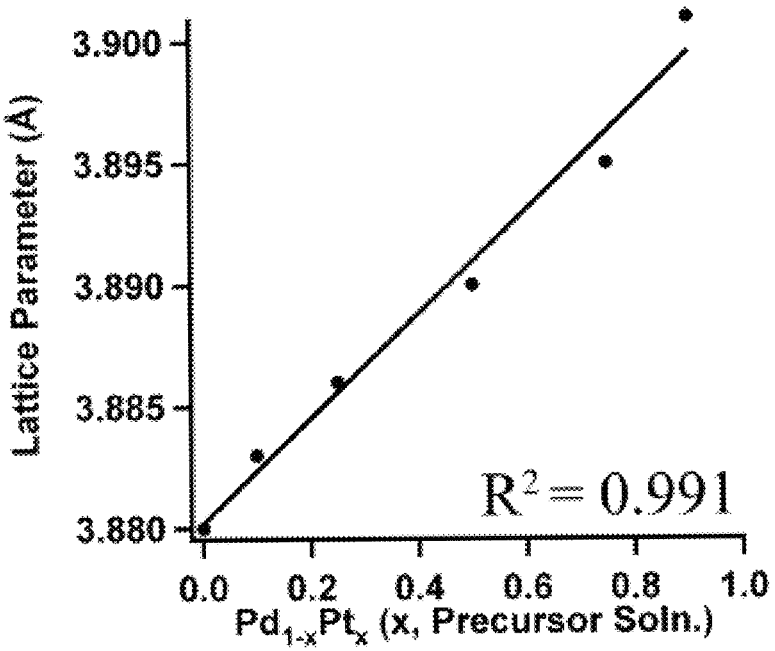
Figure 11:
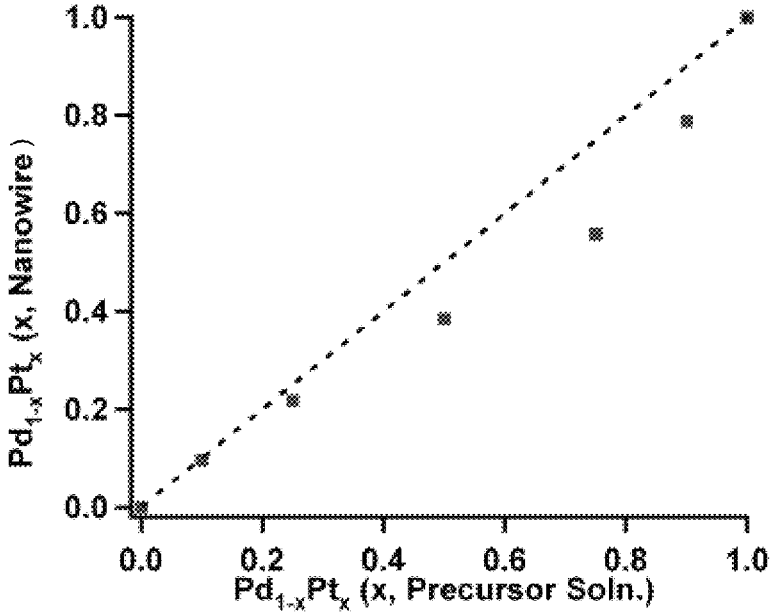
Figure 12:
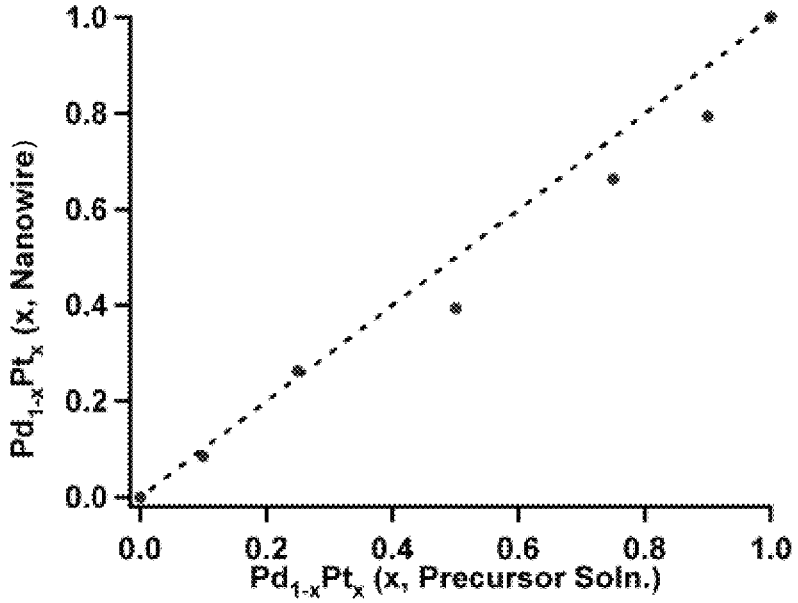

FIGS. 7-12 are graphs illustrating a relationship between measured lattice parameter and measured bimetallic nanowire composition, as a function of the concentration ratio of the first reagent and second reagent in the first solution for $A_{1-x}B_x$ nanowires, according to an embodiment of the present invention. FIGS. 7 and 10 are graphs showing lattice parameter as a function of the chemical composition of the first solution for $Pd_{1-x}Au_x$ and $Pd_{1-x}Pt_x$ nanowires, respectively. The solid line represents linear regression of data points with an $R^2$ value provided. FIGS. 8-9 are graphs showing bimetallic nanowire chemical composition as a function of chemical composition of the first solution for $Pd_{1-x}Au_x$ nanowires and FIGS. 11 and 12 are graphs showing bimetallic nanowire chemical composition as a function of chemical composition of the first solution for $Pd_{1-x}Pt_x$ nanowires. FIGS. 8 and 11 illustrate composition of the $Pd_{1-x}Au_x$ and $Pd_{1-x}Pt_x$ nanowires determined from the lattice parameter data provided by FIGS. 7 and 10, respectively. Vegard's law was employed to determine chemical composition of the nanowires according to calculated lattice parameters provided in FIGS. 7 and 10. FIGS. 9 and 12 illustrate chemical composition of $Pd_{1-x}Au_x$ and $Pd_{1-x}Pt_x$ nanowires, respectively, determined from Scanning Electron Microscopy (SEM) and Energy Dispersive X-ray spectroscopy (EDAX) measurements. Dashed lines in FIGS. 8, 9, 11, and 12 indicate a 1:1 correlation between the chemical composition of the first reagent and the second reagent and resulting bimetallic nanowires over the composition represented by x.

Referring to FIGS. 8 and 9, the composition determined by XRD and EDAX for the $Pd_{1-x}Au_x$ nanowires is in agreement with a 1:1 correlation between the chemical composition of the bimetallic nanowires and corresponding composition of the first solution. Referring to FIGS. 11 and 12, similar results are observed for $Pd_{1-x}Pt_x$ nanowires, with incorporation of palladium slightly favored. Increased palladium content in $Pd_{1-x}Pt_x$ nanowires may arise from faster diffusion of the palladium into the pores of the porous template. Thus, the composition of the bimetallic nanowires can be controlled from the composition of the first solution.

Figure 13:
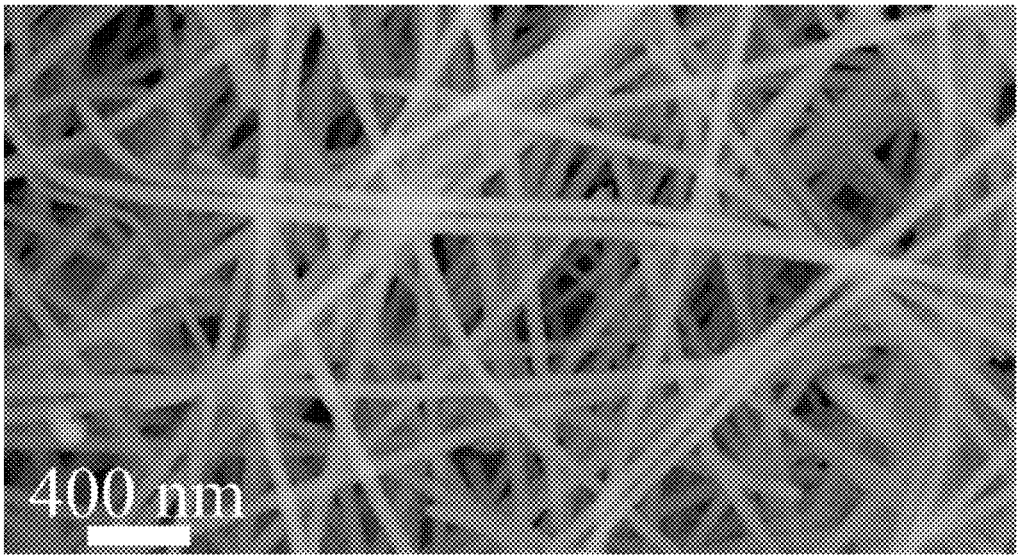
FIGS. 13-18 are Scanning Electron Microscopy (SEM) images of $A_{1-x}B_x$ nanowires, according to an embodiment of the present invention.
Figure 14:
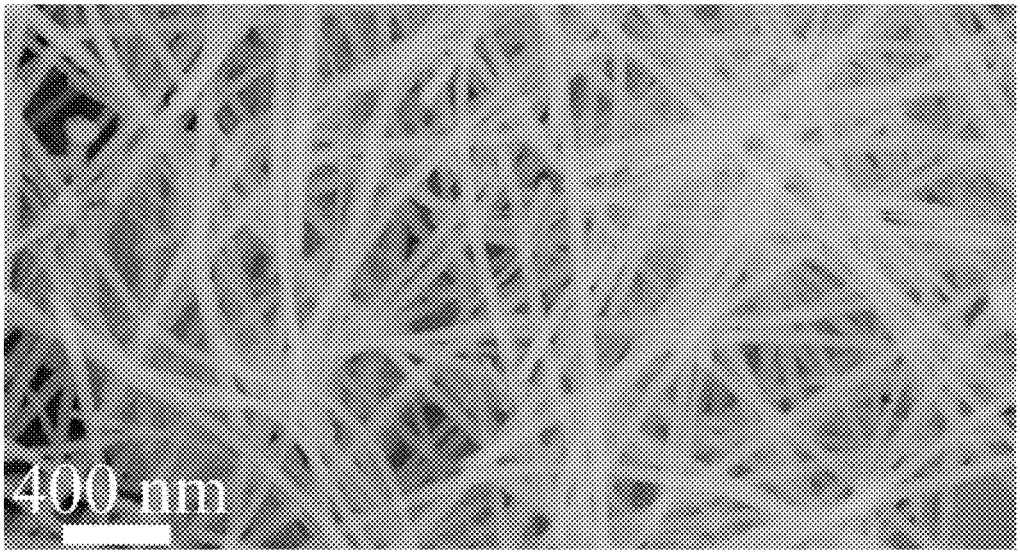
Figure 15:
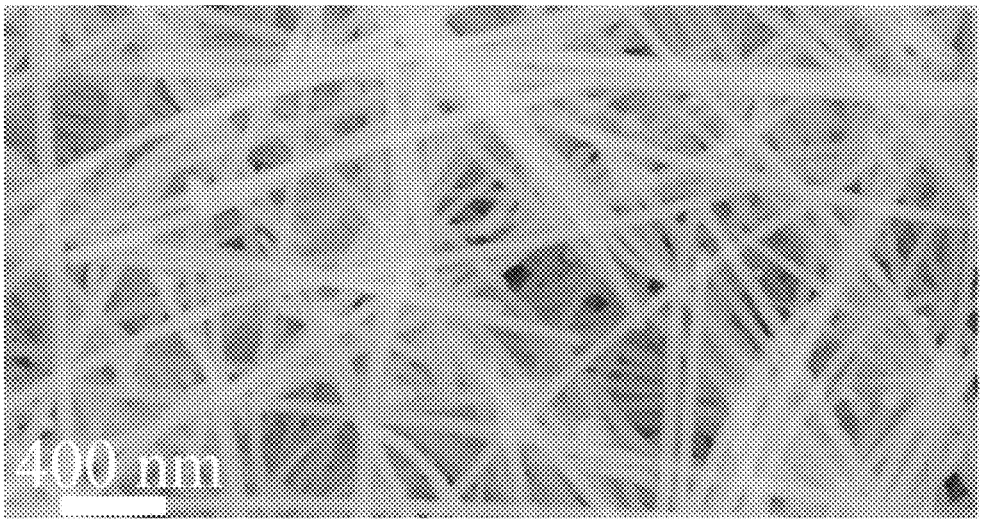
Figure 16:
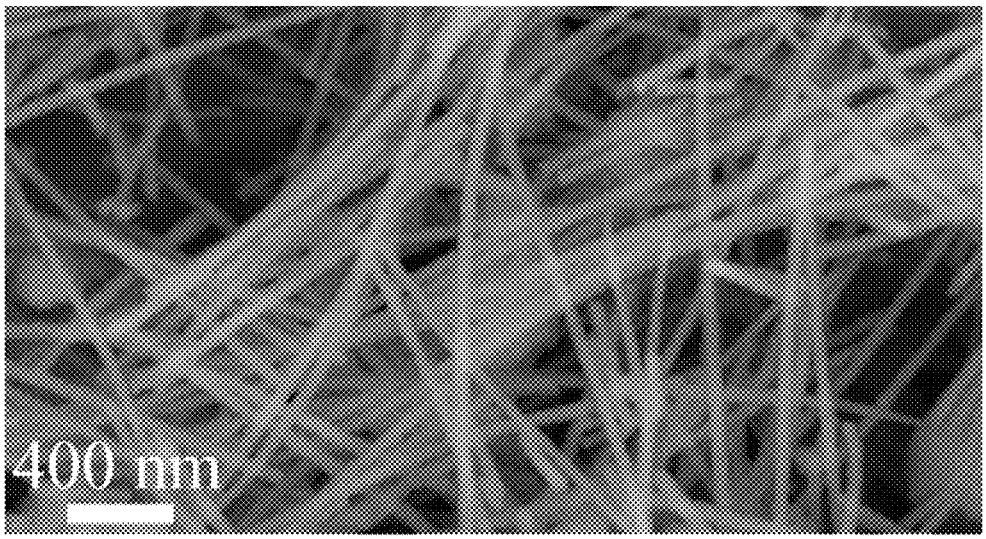
Figure 17:
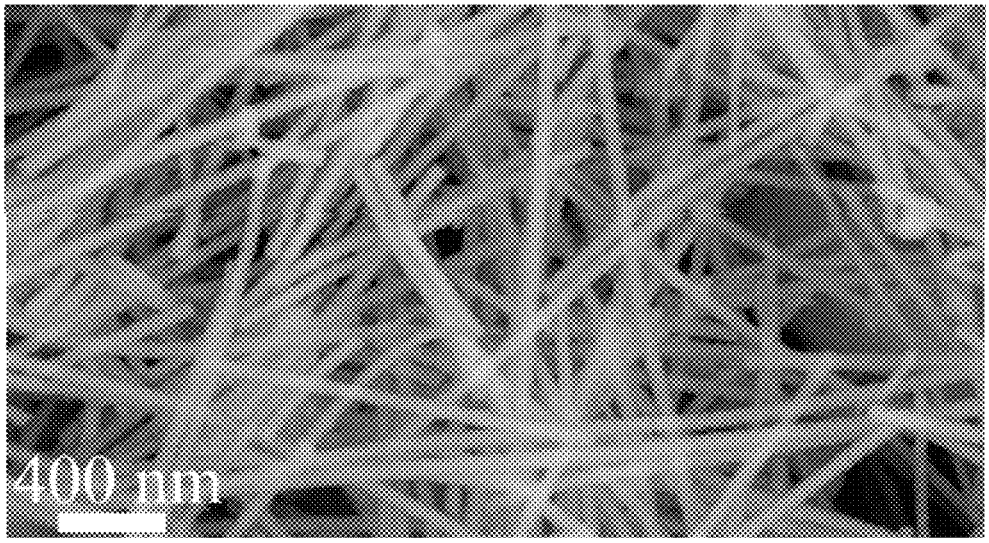
Figure 18:
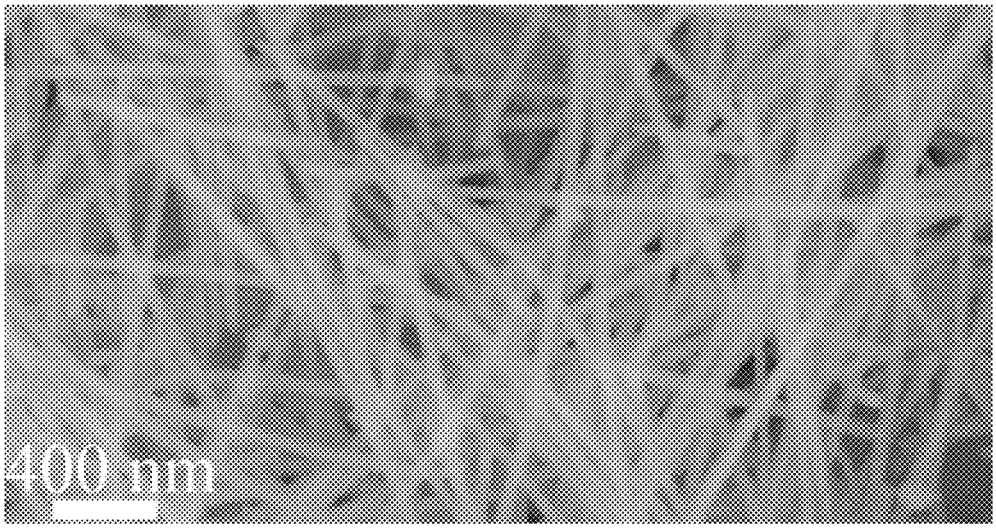

FIGS. 13-18 are Scanning Electron Microscopy (SEM) images of $A_{1-x}B_x$ nanowires, according to an embodiment of the present invention. FIGS. 13-15 illustrate SEM images of $Pd_{1-x}Au_x$ nanowires of compositions x=0.75, 0.5 and 0.25, respectively. FIGS. 16-18 illustrate SEM images of $Pd_{1-x}Pt_x$ nanowires of compositions x=0.75, 0.5 and 0.25, respectively. FIGS. 13-18 indicate uniformity and homogeneity of the bimetallic nanowires and minimal differences in diameter, aspect ratio, and surface texture as related to bimetallic nanowire composition. The $Pd_{1-x}Au_x$ and $Pd_{1-x}Pt_x$ nanowires synthesized in the 15 nm porous templates had diameters of 50±9 and 49±8 nm, respectively, with lengths of up to 6 μm, consistent with the dimensions of the pores of the porous template.

SEM images were obtained using a Hitachi S4800 SEM instrument with an operating voltage of 5 kV. SEM-EDAX measurements were collected on a Leo 1550 SEM with an operating voltage of 15 kV.

Figure 19:
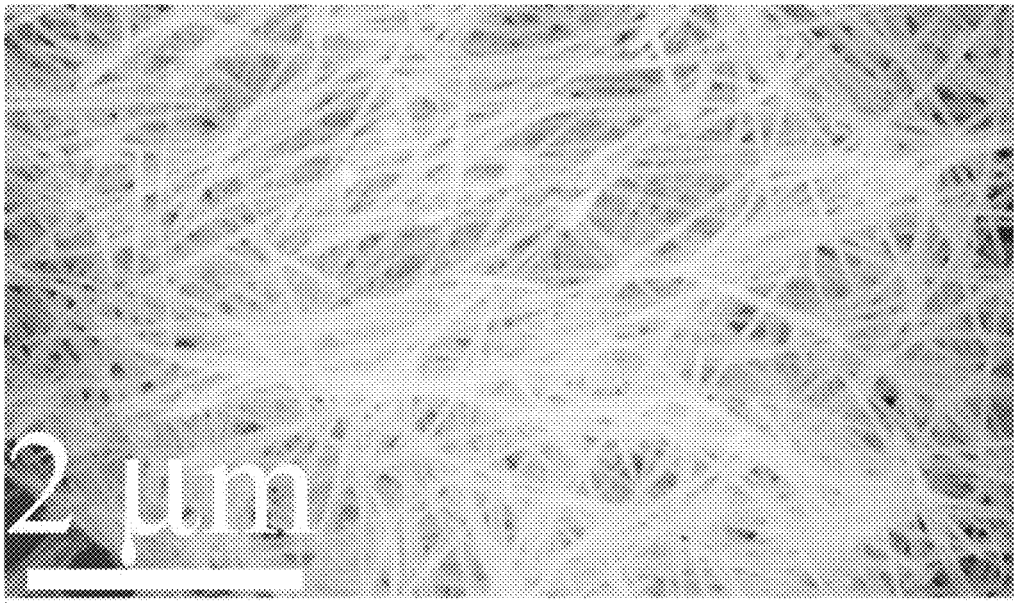
FIGS. 19-24 are SEM, Transmission Electron Microscopy (TEM), High Resolution (HRTEM) and Selected Area Electron Diffraction (SAED) images of $Pd_9Au$ nanowires, according to an embodiment of the present invention.
Figure 20:
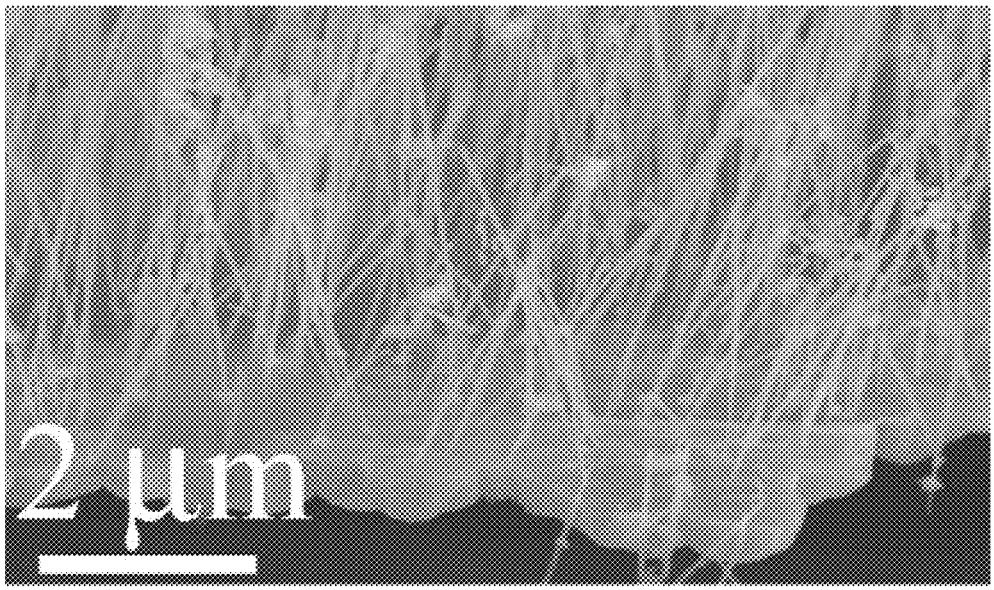

FIGS. 19-24 are SEM, Transmission Electron Microscopy (TEM), High Resolution TEM (HRTEM) and Selected Area Electron Diffraction (SAED) images of $Pd_9Au$ nanowires, according to an embodiment of the present invention. FIG. 19 illustrates an SEM image of individual $Pd_9Au$ nanowires and FIG. 20 illustrates an SEM image of $Pd_9Au$ nanowires as free-standing arrays. The ability to prepare $Pd_9Au$ nanowires as free-standing arrays makes the $Pd_9Au$ nanowires candidates for sensing and electronics applications.

Figure 21:
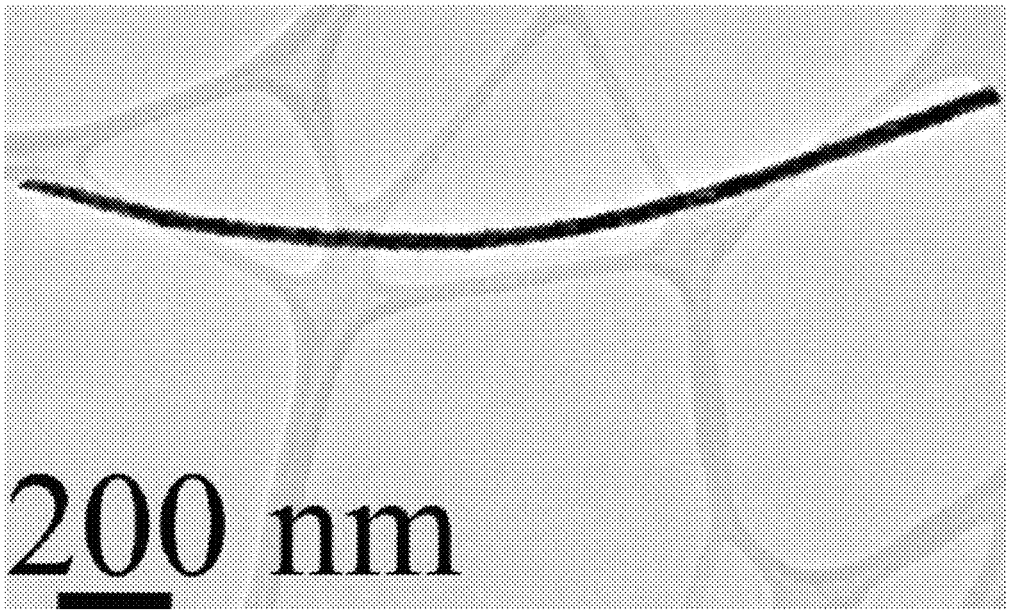
Figure 22:
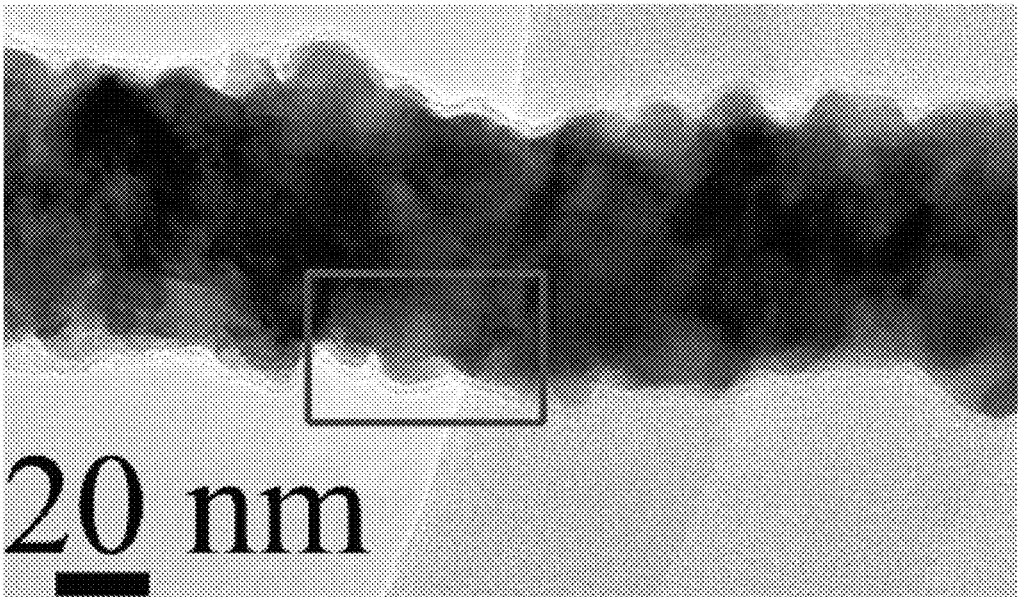

FIGS. 21 and 22 illustrate TEM images of a single $Pd_9Au$ nanowire, indicating that the $Pd_9Au$ nanowires are dense and uniform. Surfaces are uniformly faceted and facet sizes are only limited by uneven texture of the porous template's pore walls.

Figure 23:
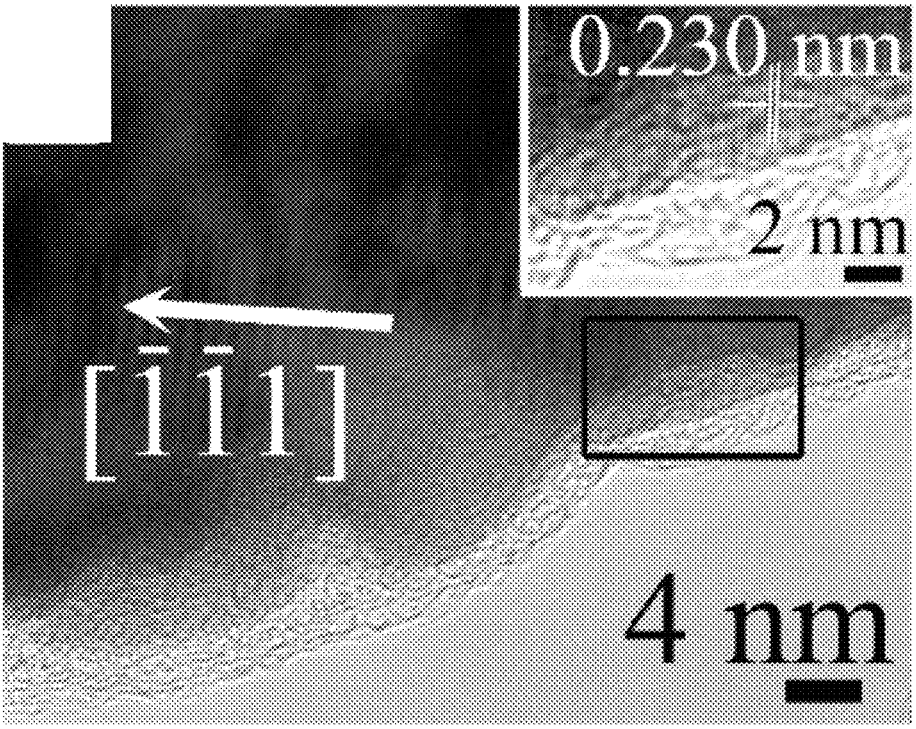
Figure 24:
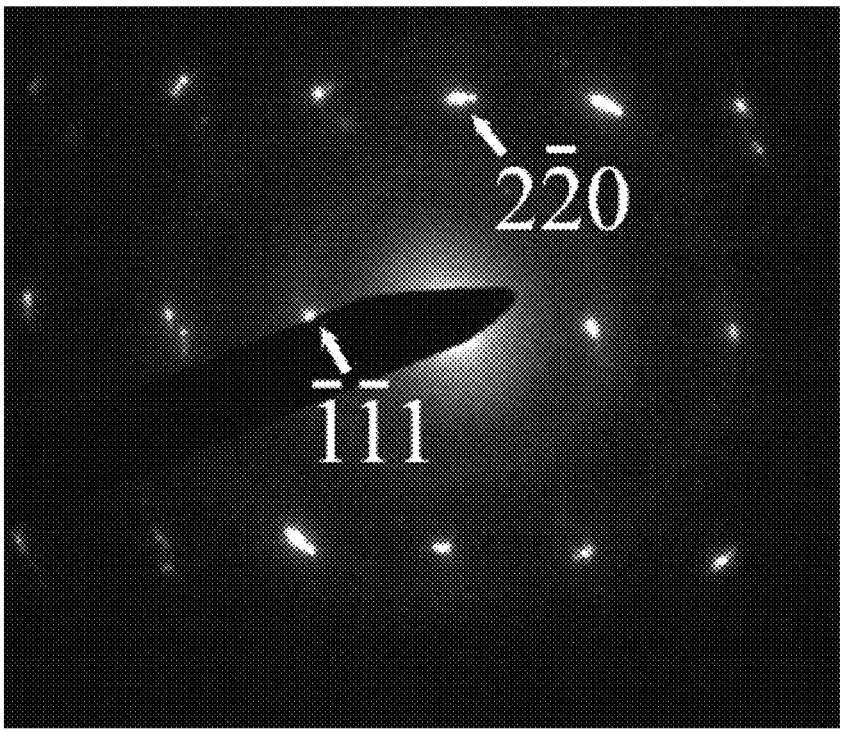

FIG. 23 illustrates an HRTEM image indicating that a long axis of the $Pd_9Au$ nanowires is oriented along a [111] crystallographic direction. A high magnification HRTEM image, shown inset to FIG. 23 and taken from the box portion of FIG. 23, was obtained along a central single crystalline segment and indicates equidistant lattice planes with a spacing of 0.230 nm. FIGS. 23 and 24 indicate that the long axis of the $Pd_9Au$ nanowires is oriented along a [111] crystallographic direction. Similar results are observed in the case of the $Pd_{1-x}Pt_x$, as described below. Additionally, FIG. 23 indicates that the $Pd_9Au$ nanowires are substantially free of impurities, since all lattice planes are assigned to the $Pd_9Au$ nanowire and no other crystalline phases are apparent.

FIG. 24 illustrates SAED patterns corresponding to FIGS. 22 and 23. FIG. 24 indicates that the $Pd_9Au$ nanowires are substantially free of impurities, since all of the diffraction spots can be assigned to the face-centered cubic crystal structure of the $Pd_9Au$ alloy phase and no impurity diffraction spots or diffraction rings are visible. The $Pd_9Au$ nanowires were supported on a lacey carbon grid and an in situ heat treatment was performed by heating the grid to above 350° C. Evolution of the $Pd_9Au$ nanowires' crystalline structure was monitored at various temperatures by obtaining SAED patterns at various points along the length of the nanowire, as described below.

HRTEM, EDAX spectra in scanning TEM mode, and SAED patterns were acquired on a JEOL 2010F instrument, equipped with a Gatan HAADF detector for performing either incoherent HAADF or Z-contrast imaging in scanning TEM mode at accelerating voltages of 200 kV.

Figure 25:
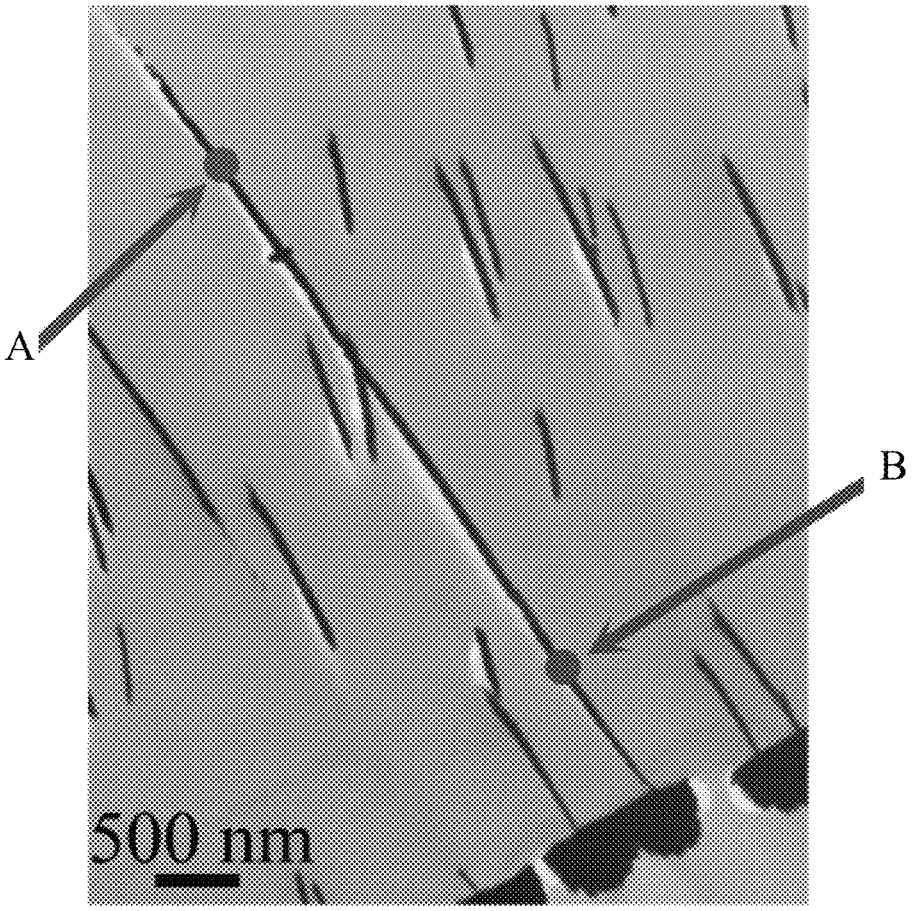
FIGS. 25-29 are TEM, HRTEM and SAED images of a cross-section of a template containing $Pd_9Au$ nanowires, according to an embodiment of the present invention.
Figure 26:
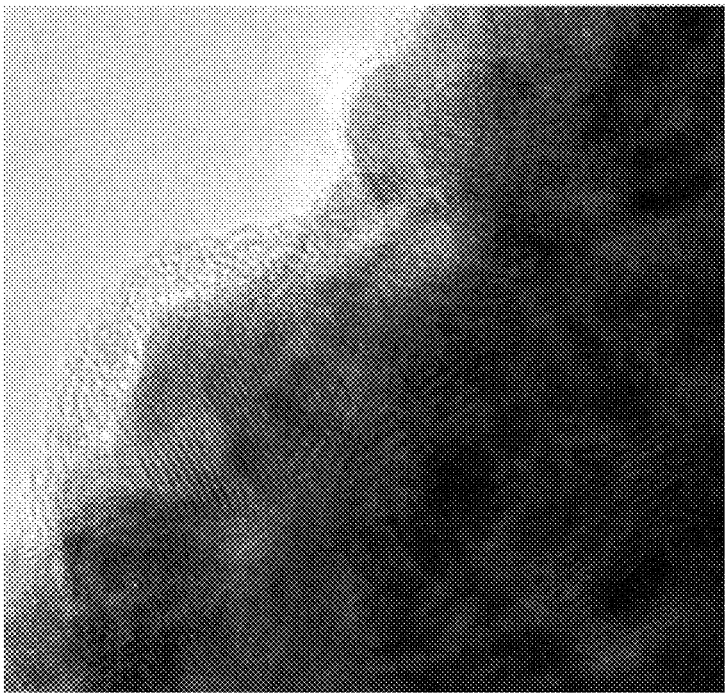
Figure 27:
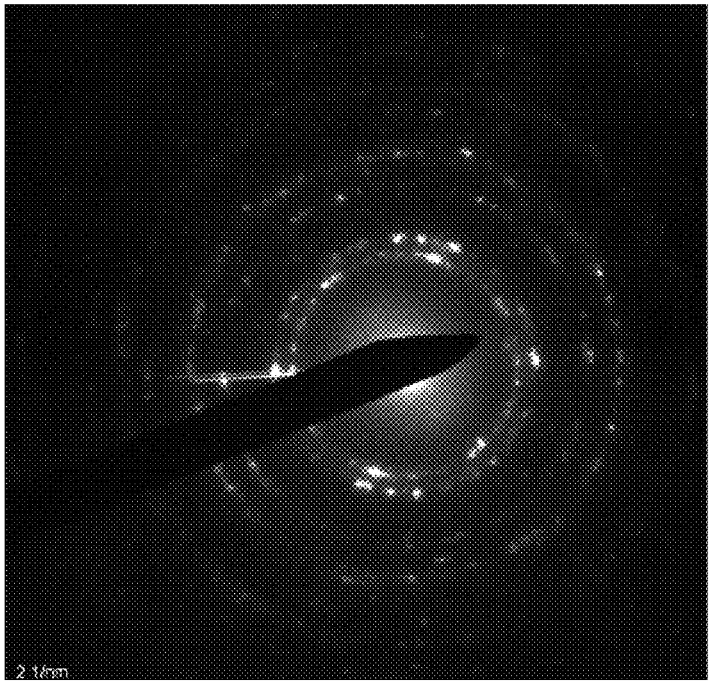
Figure 28:
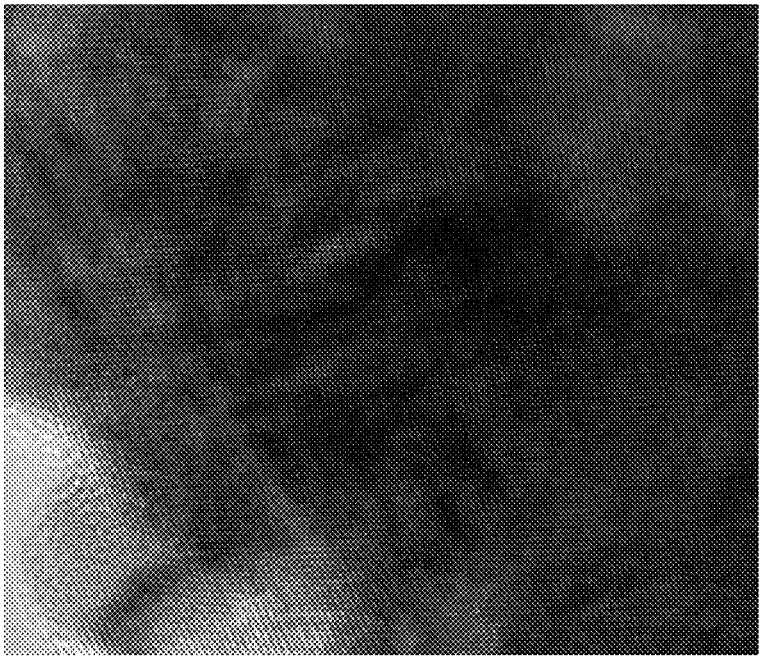
Figure 29:
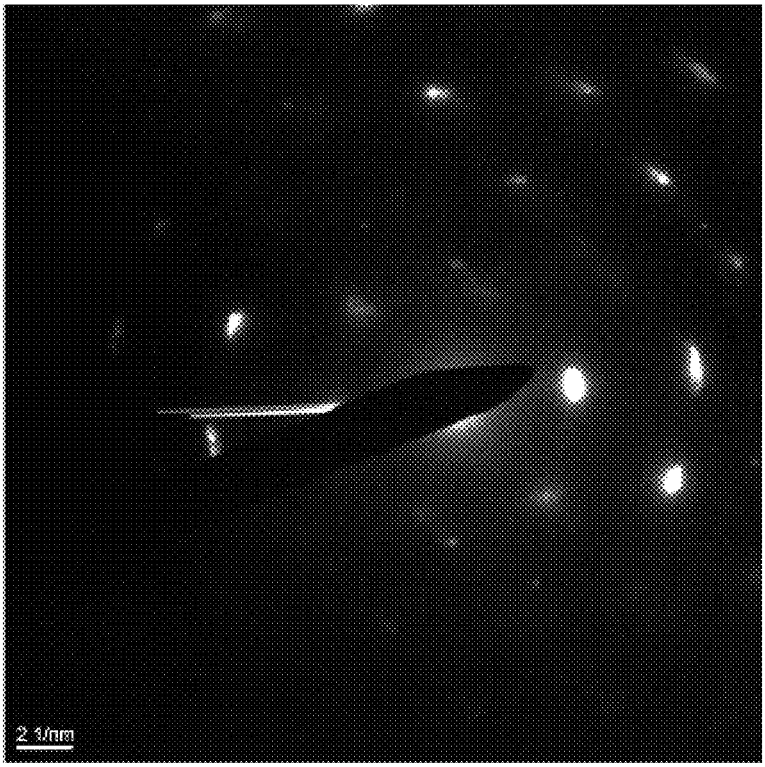

FIGS. 25-29 are TEM, HRTEM and SAED images of a cross-section of a template containing $Pd_9Au$ nanowires, according to an embodiment of the present invention. FIG. 25 illustrates a TEM image of a cross-section of a porous template having 15 nm pores containing the $Pd_9Au$ nanowires. FIG. 26 illustrates an HRTEM image taken from point A of FIG. 25 where polycrystalline growth is predominant and FIG. 27 illustrates a corresponding SAED pattern. FIG. 28 illustrates an HRTEM image taken from point B of FIG. 25 where single crystalline growth is predominant and FIG. 29 illustrates a corresponding SAED pattern. FIGS. 25-29 indicate that the length of polycrystalline and the single crystalline segments of the $Pd_9Au$ nanowires, as well as of the entire length of the $Pd_9Au$ nanowires, can be controlled according to the concentration of the first and second solutions.

The TEM Images of cross-sections of the $Pd_9Au$ nanowires were obtained on a Technai 12 BioTwinG$^2$ TEM instrument equipped with an AMT XR-60 CCD camera system. The cross sections of the porous templates for imaging by TEM were prepared by embedding the porous templates in Epon resin and 80 nm sections were cut with a Reichert-Jung UltracutE Ultramicrotome.

Figure 30:
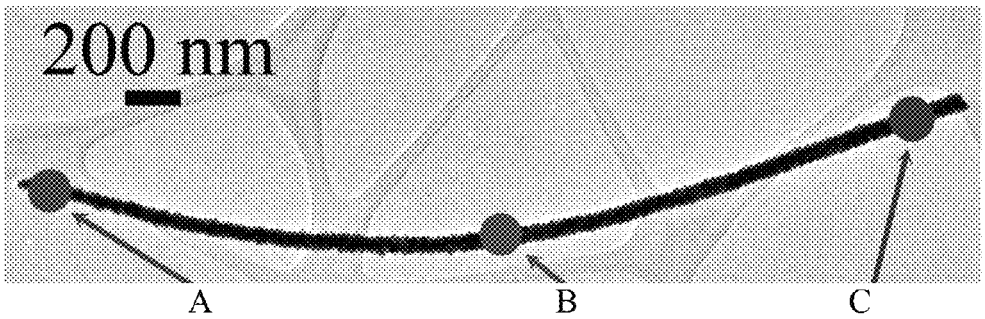
FIGS. 30-33B are TEM and SAED images after heating of $Pd_9Au$ nanowires, according to an embodiment of the present invention.
Figure 31A:
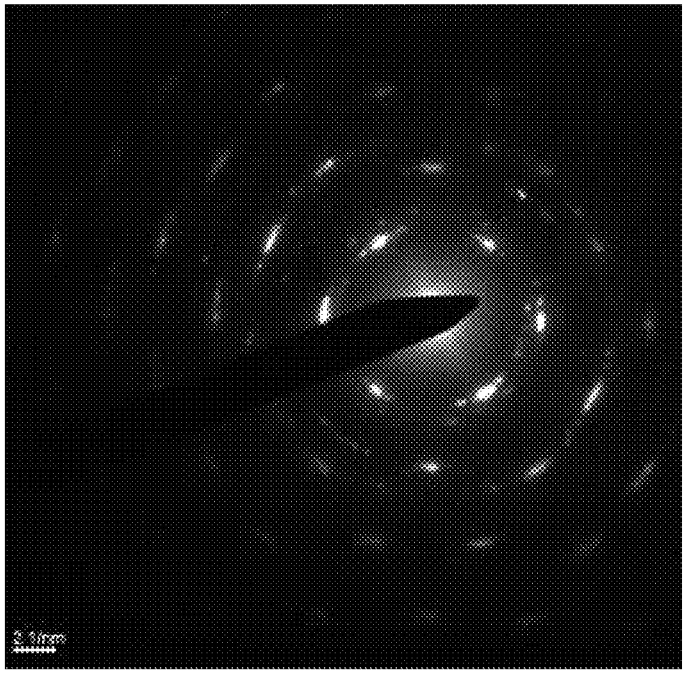
Figure 31B:
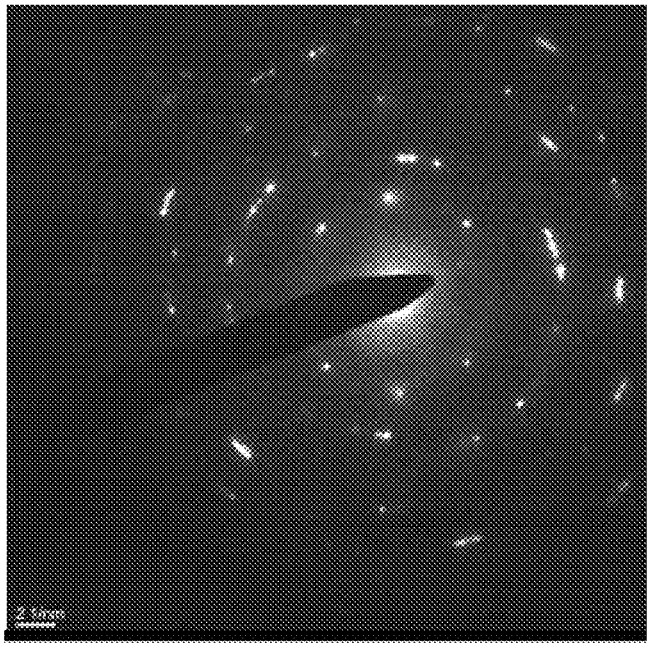
Figure 32A:
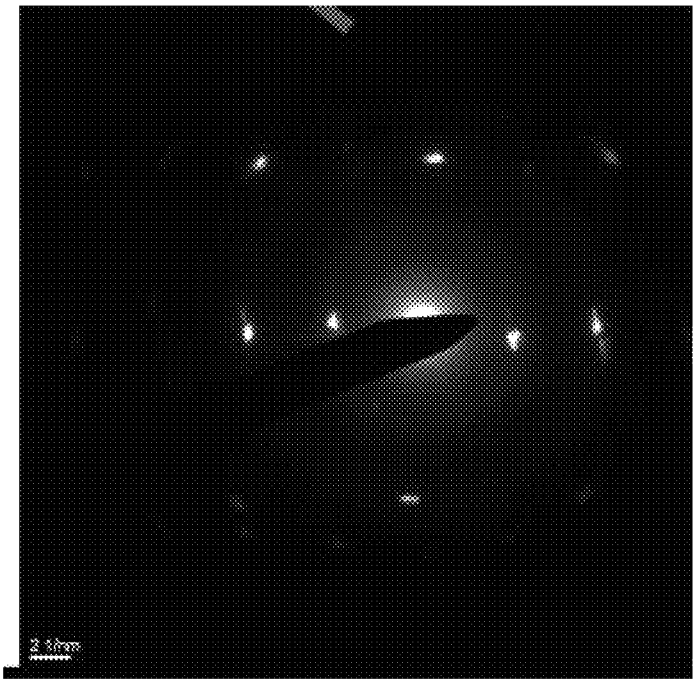
Figure 32B:
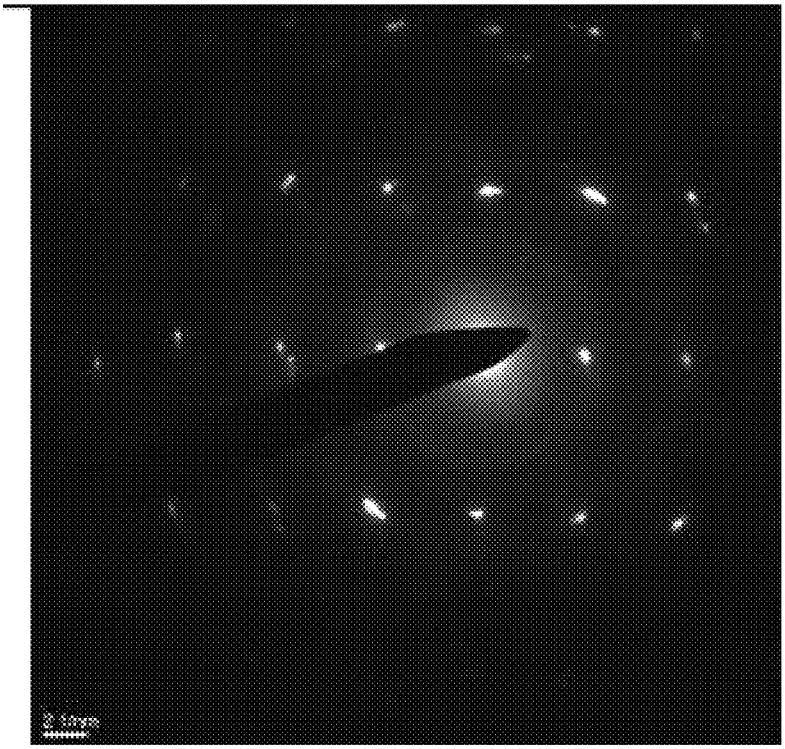
Figure 33A:
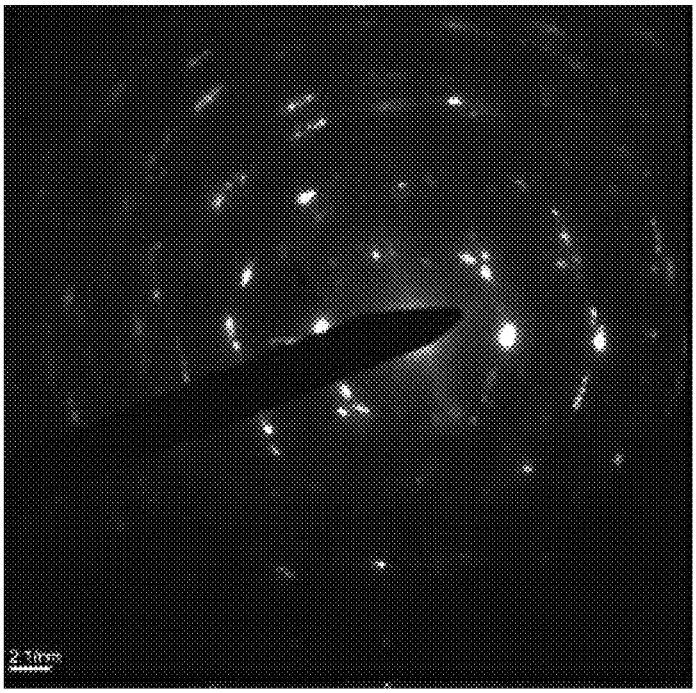
Figure 33B:
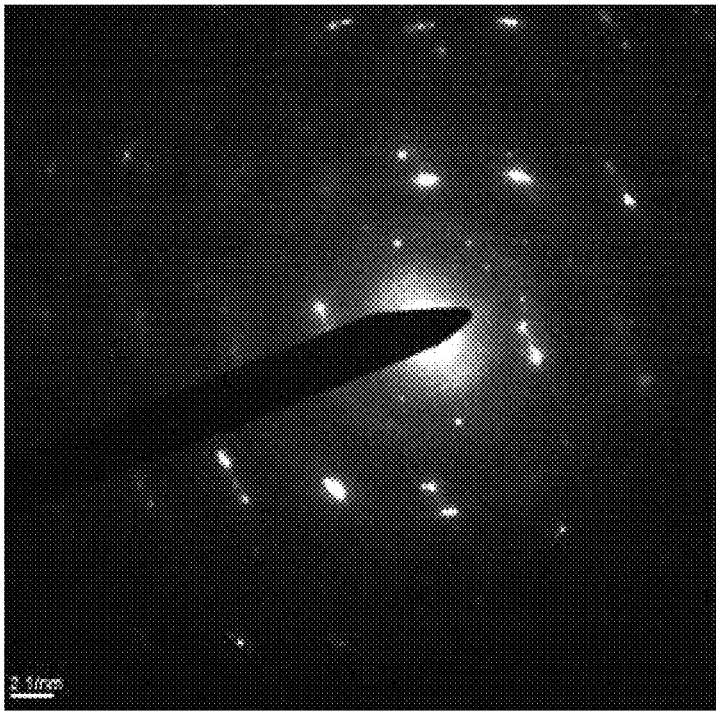

FIGS. 30-33B are TEM and SAED images after heating of $Pd_9Au$ nanowires, according to an embodiment of the present invention. FIG. 30 illustrates a TEM image of a $Pd_9Au$ nanowire. FIG. 31A illustrates an SAED image obtained after brief in situ heat treatment at 200° C. at point A of FIG. 30. FIG. 31B illustrates an SAED image obtained after brief in situ heat treatment at 400° C. at point A of FIG. 30. FIG. 32A illustrates an SAED image obtained after brief in situ heat treatment at 200° C. at point B of FIG. 30. FIG. 32B illustrates an SAED image obtained after brief in situ heat treatment at 400° C. at point B of FIG. 30. FIG. 33A illustrates an SAED image obtained after brief in situ heat treatment at 200° C. at point C of FIG. 30. FIG. 33B illustrates an SAED image obtained after brief in situ heat treatment at 400° C. at point C of FIG. 30. Accordingly, FIGS. 31A-33B indicate that central portions of the $Pd_9Au$ nanowires are textured and single crystalline, with short polycrystalline segments restricted to ends of the $Pd_9Au$ nanowire.

Figure 34:
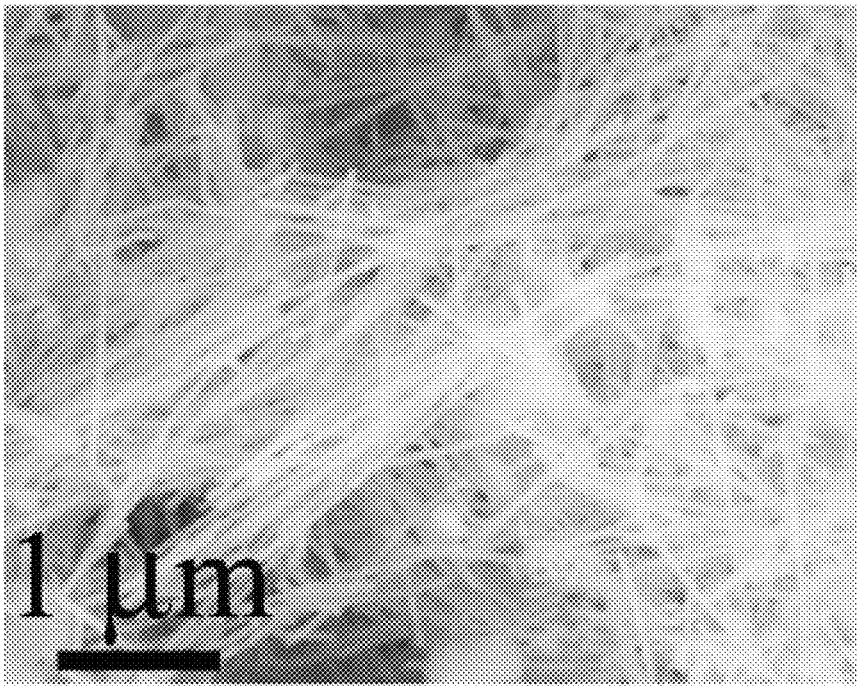
FIGS. 34-39 are SEM, TEM and HRTEM images of $Pd_3Pt_7$ nanowires, according to an embodiment of the present invention.
Figure 35:
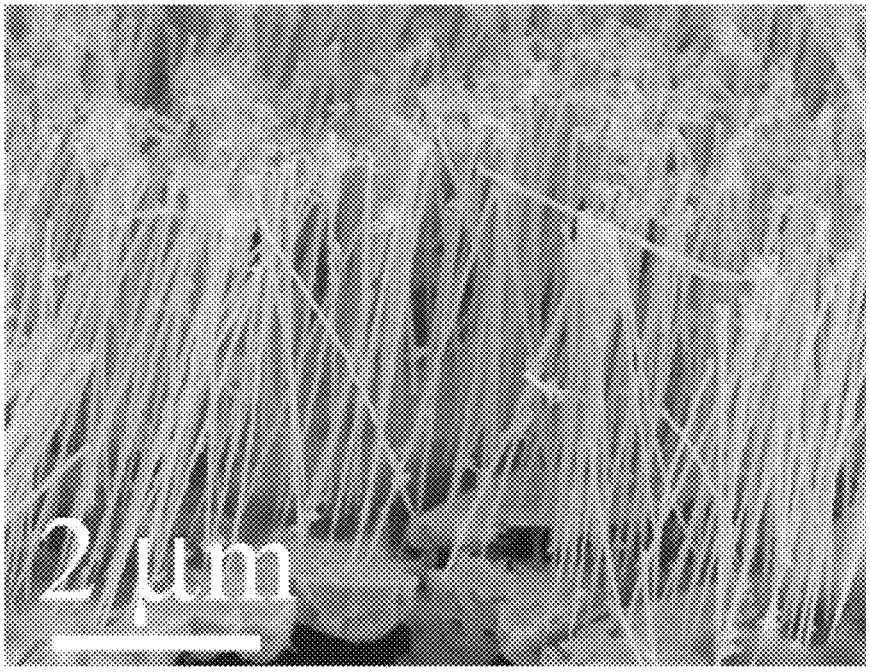
Figure 36:
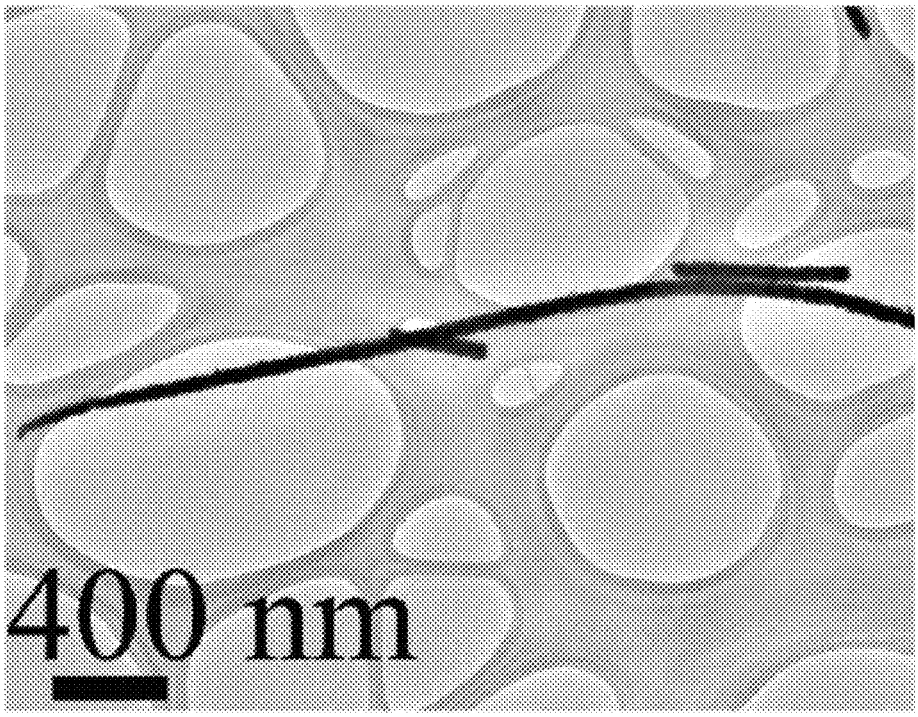
Figure 37:
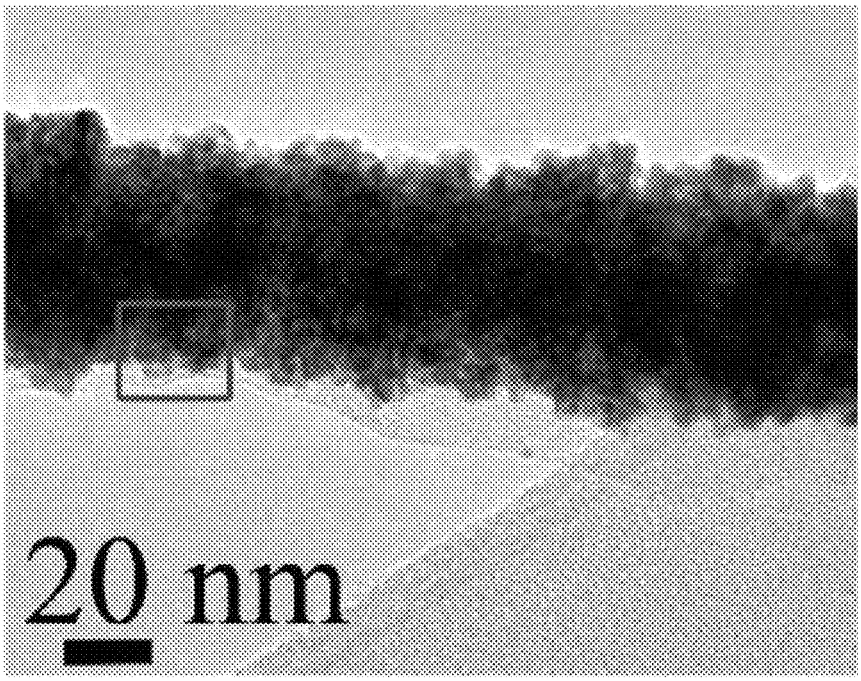
Figure 38:
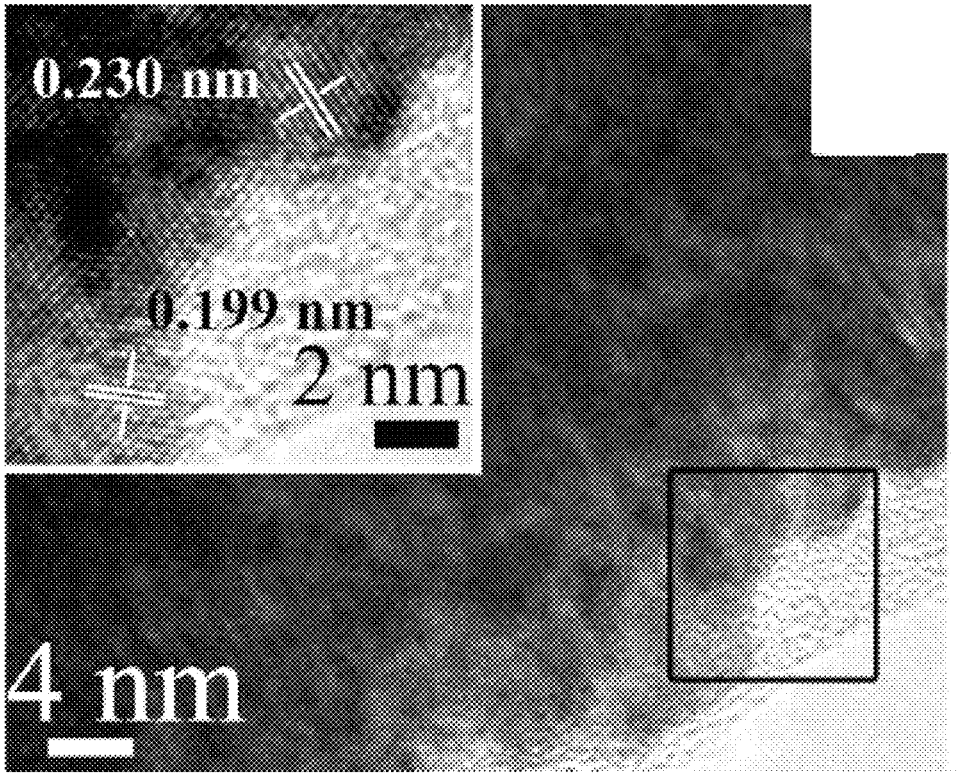
Figure 39:
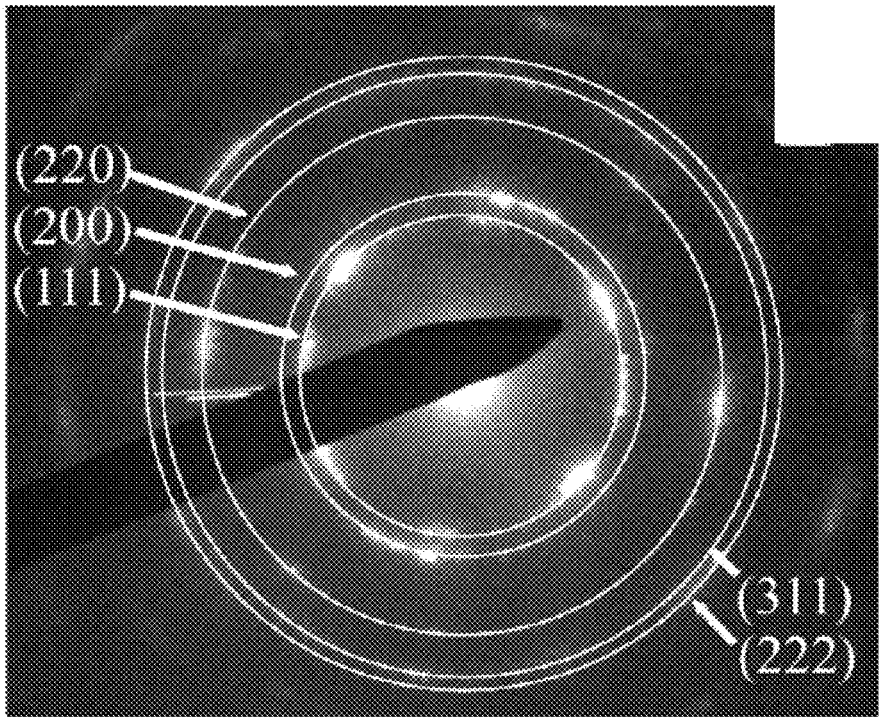

FIGS. 34-39 are SEM, TEM and HRTEM images of $Pd_3Pt_7$ nanowires, according to an embodiment of the present invention. FIGS. 34 and 35 are SEM images of $Pd_3Pt_7$ nanowires as individual nanowires and as a free-standing nanowire array, respectively. FIG. 36 is a TEM image of a single $Pd_3Pt_7$ nanowire. FIG. 37 is an HRTEM image highlighting a central portion of the $Pd_3Pt_7$ nanowire. The box portion in FIG. 37 indicates the location where the HRTEM image of FIG. 38 was obtained. Inset to FIG. 38 is an area taken from the box portion of FIG. 38, highlighting (111) and (200) lattice planes. FIGS. 38 and 39 indicate that the $Pd_3Pt_7$ nanowires are not single crystalline, but are composed of an aggregated ensemble of oriented crystallites, i.e., polycrystalline.

Figure 40:
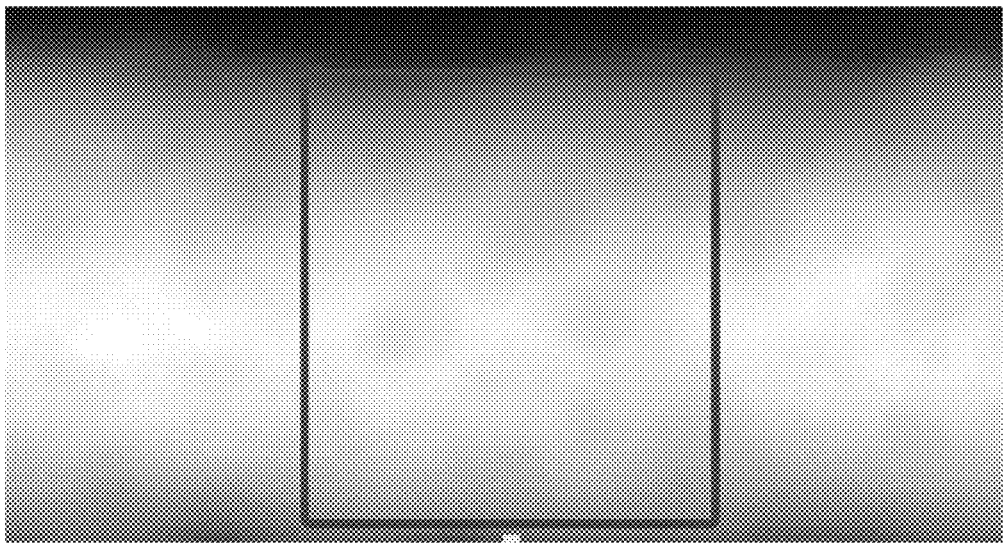
FIGS. 40-43 are High Angle Annular Dark Field (HAADF) images, Energy Dispersive X-ray spectroscopy (EDAX) maps, a TEM image, and a graph of EDAX data of $Pd_9Au$ nanowires, according to an embodiment of the present invention.
Figure 41A:
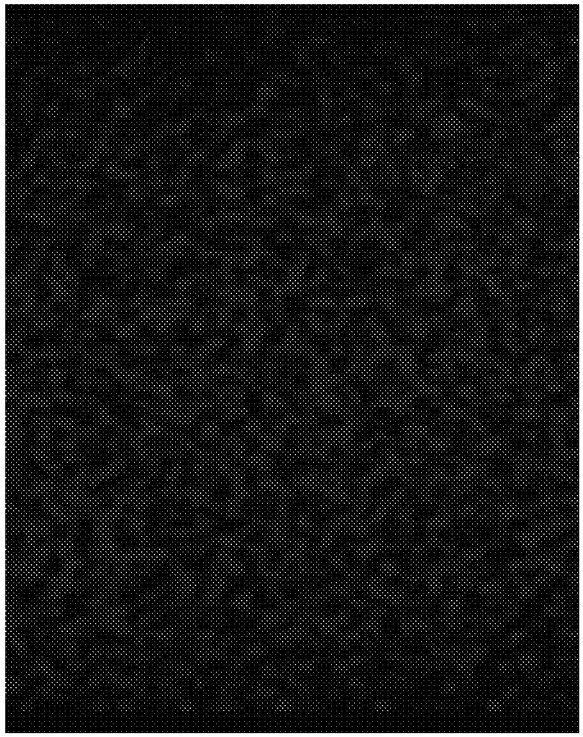
Figure 41B:
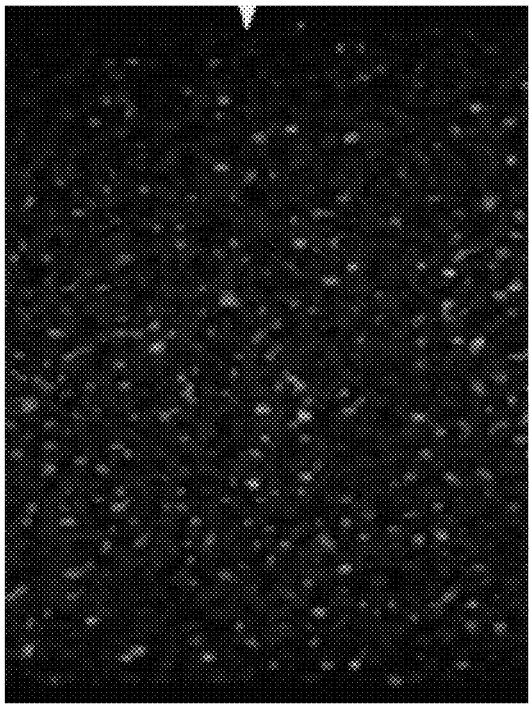
Figure 41C:
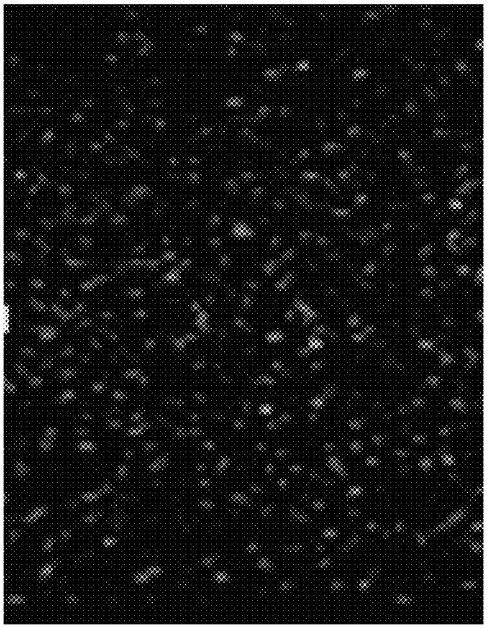

FIGS. 40-43 are High Angle Annular Dark Field (HAADF) images, EDAX maps, a TEM image, and a graph of EDAX data of $Pd_9Au$ nanowires, according to an embodiment of the present invention. FIG. 40 illustrates an HAADF image of the $Pd_9Au$ nanowire. Contrast, which is sensitive to atomic number, is homogeneous, indicating that the $Pd_9Au$ nanowires maintain uniform and consistent composition. The few areas of lighter contrast result from uneven texture of the $Pd_9Au$ nanowire surface as well as porosity within the $Pd_9Au$ nanowire. FIGS. 41A-41C are EDAX maps obtained from the box portion in FIG. 40. The EDAX maps of FIGS. 41A-41C are spatially resolved. FIG. 41A was obtained from the intensity of measured palladium L-edge signals. FIG. 41C was obtained from the intensity of measure gold L-edge signals. FIG. 41B is a combined map of FIGS. 41A and 41C.

Figure 42:
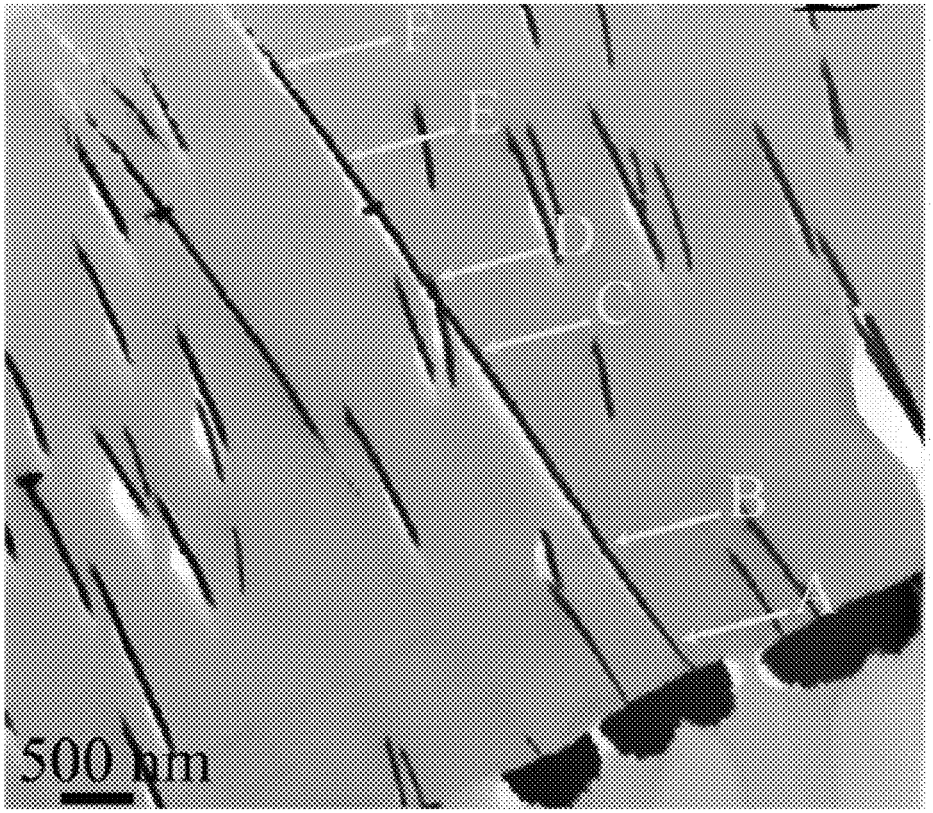
Figure 43:
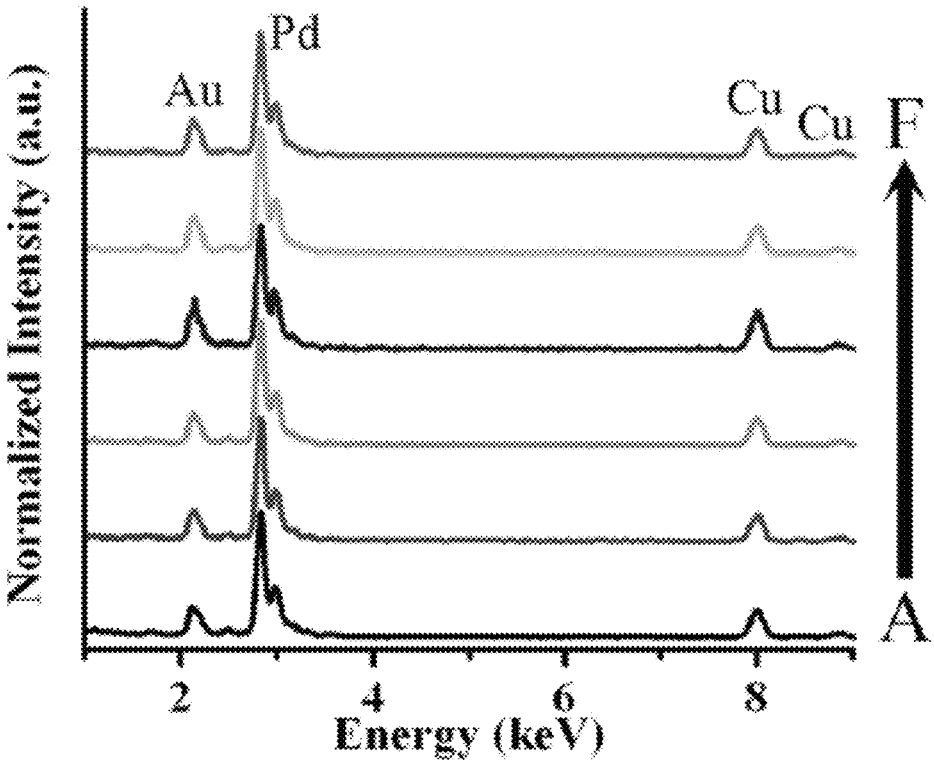

FIG. 42 illustrates a TEM image of a cross-section of a porous template containing the $Pd_9Au$ nanowires including positions A-F taken along a length of an individual $Pd_9Au$ nanowire. EDAX spectra shown in FIG. 43 were obtained at corresponding positions A-F indicated in the TEM image of FIG. 42. Chemical compositions at each position A-F in FIG. 42 are shown in Table 1, indicating that distribution of palladium and gold is uniform along the length of the $Pd_9Au$ nanowire.

TABLE 1

| Nanowire Position | Percent Palladium | Percent Gold |
|---|---|---|
| A | 91 | 9 |
| B | 91 | 9 |
| C | 91 | 9 |
| D | 88 | 12 |
| E | 90 | 10 |
| F | 90 | 10 |

Figure 44:
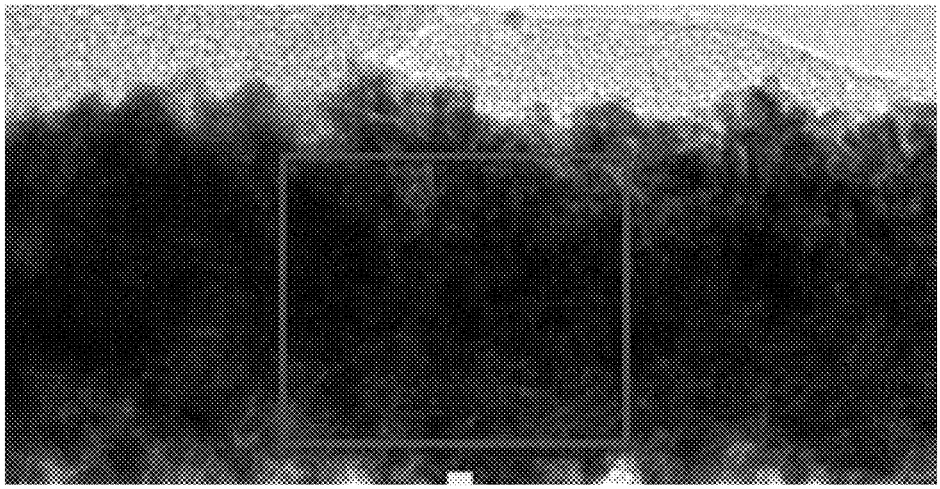
FIGS. 44-47 are HAADF images, EDAX maps, a TEM image and a graph of EDAX data of $Pd_3Pt_7$ nanowire, according to an embodiment of the present invention.
Figure 45A:
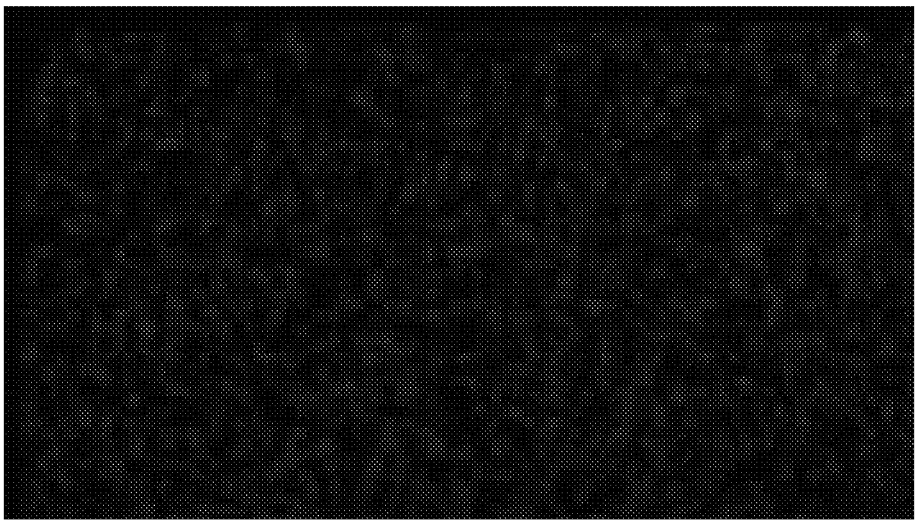
Figure 45B:
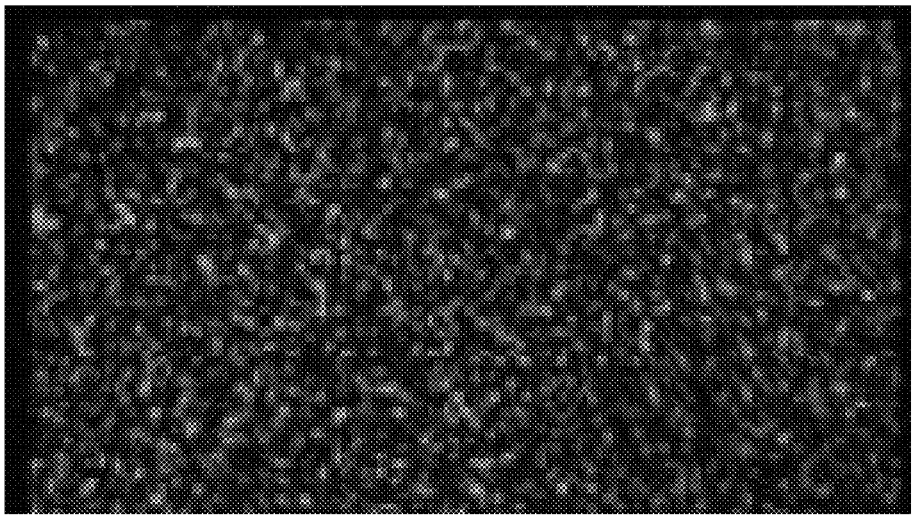
Figure 45C:
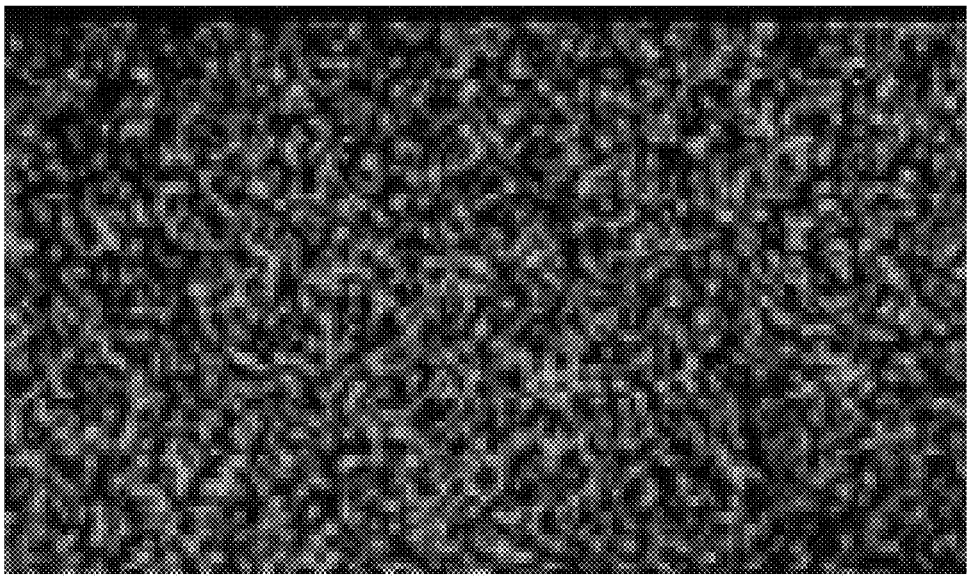
Figure 46:
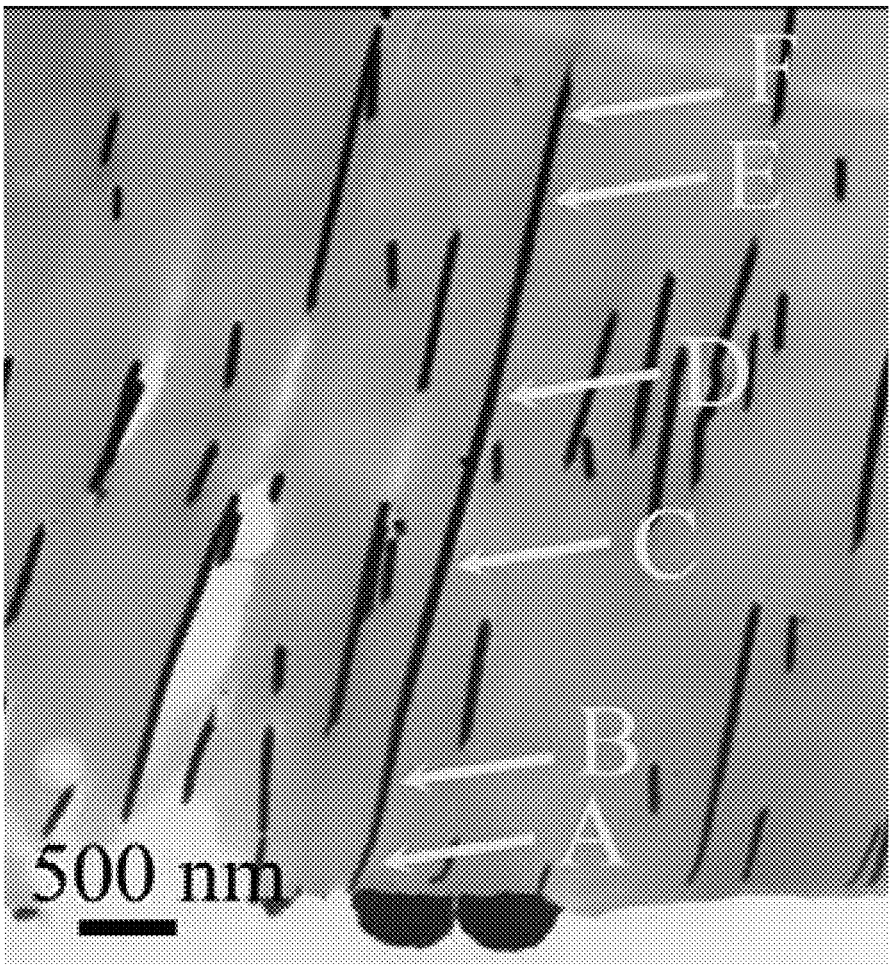
Figure 47:
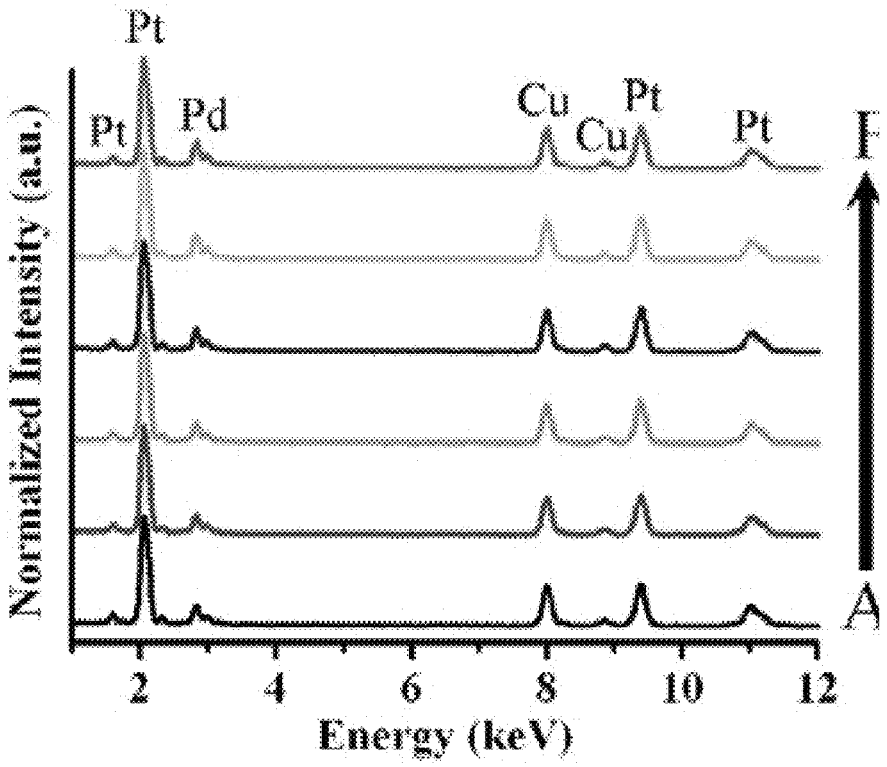

FIGS. 44-47 are HAADF images, EDAX maps, a TEM image and a graph of EDAX data of $Pd_3Pt_7$ nanowire, according to an embodiment of the present invention. FIG. 44 illustrates a HAADF image showing a central segment of an individual $Pd_3Pt_7$ nanowire. FIGS. 45A-45C are spatially resolved EDAX maps obtained from the area denoted by the box in FIG. 44. FIG. 45A was obtained from the intensity of measured palladium L-edge signals. FIG. 45C was obtained from the intensity of measured platinum L-edge signals. FIG. 45B is a combined map of FIGS. 45A and 45C. FIG. 46 illustrates a TEM image of a cross-section of a porous template containing the $Pd_3Pt_7$ nanowires including positions A-F. FIG. 47 illustrates EDAX spectra obtained on the individual $Pd_3Pt_7$ nanowire, corresponding to positions A-F indicated in FIG. 46.

FIGS. 44-47 collectively indicate that the $Pd_3Pt_7$ nanowires become enriched with platinum as the $Pd_3Pt_7$ nanowires elongate in the pores of the porous template. Chemical composition of the $Pd_3Pt_7$ nanowires was obtained from FIG. 47 at positions A-F. Chemical composition at each position A-F in FIG. 46 are shown in Table 2.

TABLE 2

| Nanowire Position | Percent Palladium | Percent Platinum |
|---|---|---|
| A | 28 | 72 |
| B | 28 | 72 |
| C | 27 | 73 |
| D | 29 | 71 |
| E | 33 | 67 |
| F | 34 | 66 |

The EDAX maps of the $Pd_9Au$ and $Pd_3Pt_7$ nanowires shown in FIGS. 41A-41C and 42A-42C, respectively, indicate that spatial distributions of the metals are uniform throughout the bimetallic nanowire and that minimal segregation of the metals into discrete phases occurs. These results are consistent with the XRD data of FIGS. 5 and 6 and HRTEM images for the $Pd_9Au$ nanowires of FIGS. 23 and 24 and for the $Pd_3Pt_7$ nanowires of FIGS. 38 and 39.

Figure 48:
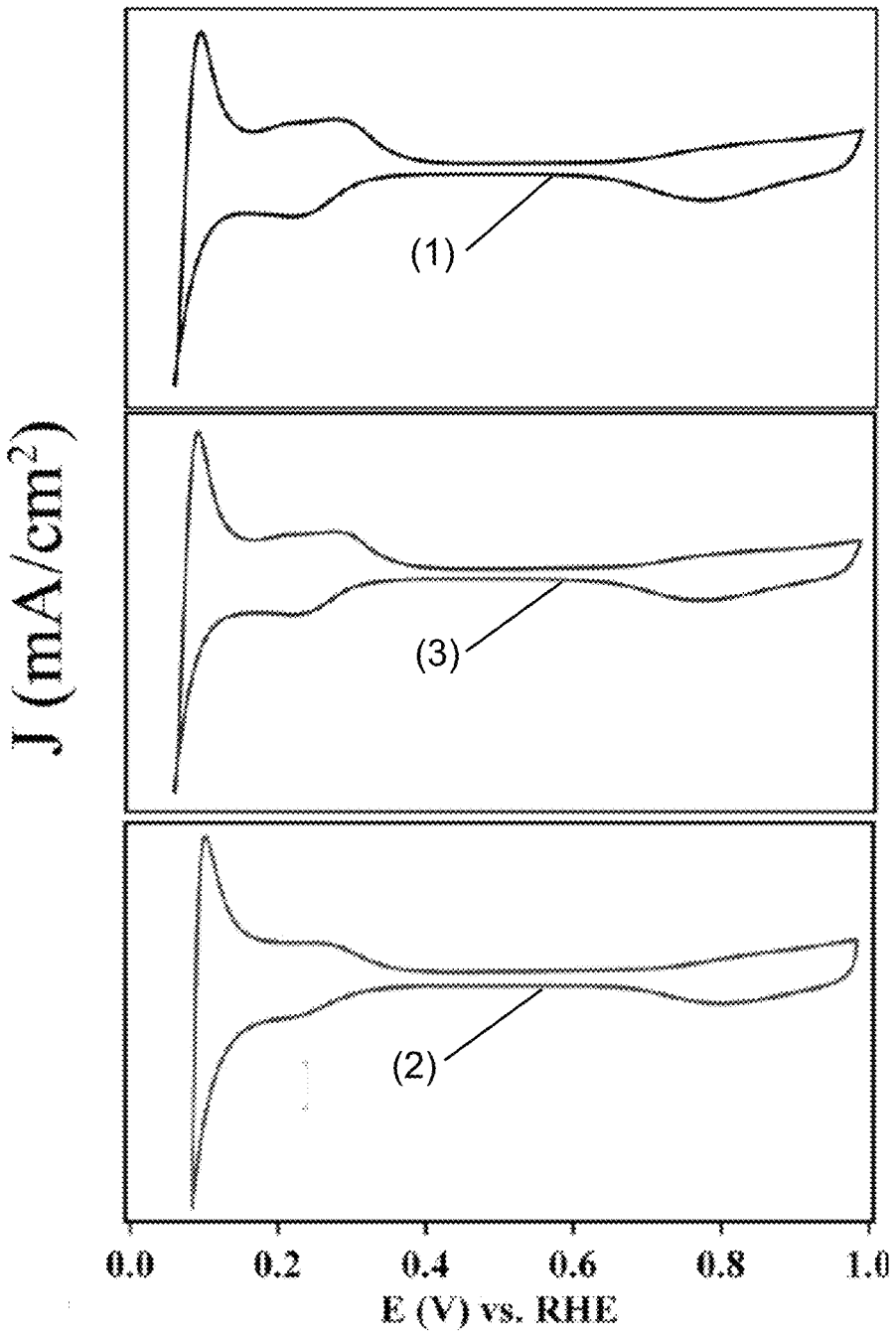
FIGS. 48-50 compare electrocatalytic performance of monometallic palladium nanowires, bimetallic $Pd_9Au$ nanowires synthesized according to an embodiment of the present invention, and gold modified monometallic palladium nanowires.
Figure 49:
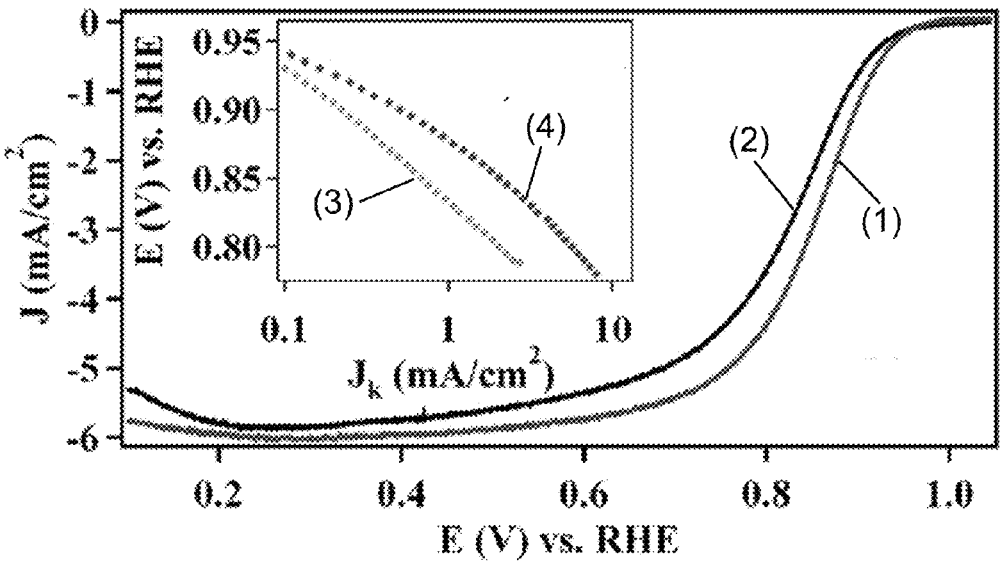
Figure 50:
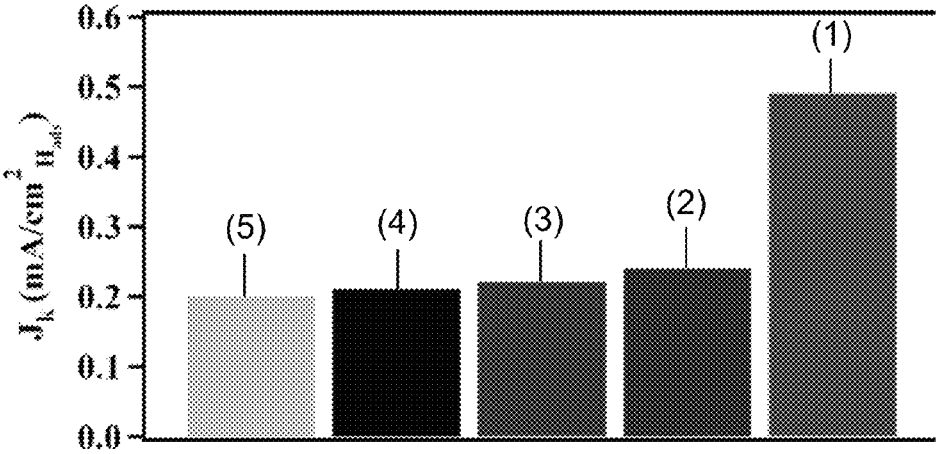

FIGS. 48-50 are graphs comparing electrocatalytic performance of monometallic palladium nanowires, bimetallic $Pd_9Au$ nanowires according to an embodiment of the present invention, and gold modified monometallic palladium nanowires. FIGS. 48-50 illustrate influence of morphology on electrochemical performance of bimetallic nanowires. FIG. 48 provides graphs of cyclic voltammograms obtained from (1) monometallic palladium nanowires; (2) $Pd_9Au$ nanowires synthesized according to an embodiment of the present invention and; (3) monometallic palladium nanowires modified with gold atoms at the monometallic nanowire's surface by Cu Underpotential Deposition (UPD) followed by a Galvanic Displacement (GD) protocol (Cu UPD/GD).

The cyclic voltammogram of the $Pd_9Au$ nanowires in line (2) of FIG. 48 illustrates the characteristic surface oxide formation at 0.6-1.0 V and hydrogen adsorption/desorption ($H_{ads}$) at 0.1-0.4 V. Presence of these features in the cyclic voltammogram highlight the purity of the $Pd_9Au$ nanowires since peaks associated with organic contaminants are not present. Further, an oxide reduction peak of the $Pd_9Au$ nanowires at 0.7963 V is shifted by approximately 20 mV to higher potentials as compared with the palladium nanowires of line (1) of FIG. 48, which have the oxide reduction peak at 0.7729 V. This shift indicates that the $Pd_9Au$ nanowires maintain improved ORR performance as a result of weaker interaction with adsorbed oxygen. Additionally, smooth shape of the $H_{ads}$ region of the $Pd_9Au$ nanowires resembles that of an active Pt (111) surface.

Oxygen reduction performance of the bimetallic nanowires was determined using a thin layer Rotating Disk Electrode (RDE) method. First, cyclic voltammograms were obtained in argon-saturated 0.1 M $HClO_4$ at a scan rate of 20 mV/s in order to establish the Electrochemical Surface Area (ESA). Specifically, the ESA was measured by converting average hydrogen absorption and desorption charge after double layer corrections into a surface area utilizing 0.21 $\mu C/cm^2$ as the known conversion factor. In the case of nanowires including palladium, absorption of hydrogen into the palladium lattice contributes to the measured $H_{ads}$ charge. Thus, use of this measurement technique in the case of palladium-based nanowires may result in measured surface areas representing an overestimate of true ESA. Additionally, surface gold atoms do not undergo $H_{ads}$ and therefore do not contribute to the $H_{ads}$ charge. Accordingly, the ESA of $Pd_9Au$ nanowires, for example, is related to a fraction of surface sites occupied by palladium atoms, which is about 90%. Thus, measurement of specific activity of the $Pd_9Au$ nanowires relates to the palladium active sites as opposed to the entire surface area of the bimetallic nanowire.

Measured kinetic current ($I_K$) was calculated utilizing the Koutecky-Levich relationship of Eq. 1:

$$\frac{1}{I_{0.9\,V}} = \left(\frac{1}{I_K} + \frac{1}{I_D}\right) \quad \text{Eq. (1)}$$

where I is current measured at 0.9 V and $I_D$ is a diffusion limited current at 0.4 V. $I_K$ was normalized to either the ESA, platinum mass, or platinum group metal mass of the catalyst loaded onto the RDE, respectively, in order to obtain surface area or mass normalized kinetic current ($J_K$) densities. Activity of the bimetallic nanowires toward oxygen reduction was measured by obtaining polarization curves in an oxygen-saturated 0.1 M $HClO_4$ electrolyte at 20° C. with an electrode rotating rate of 1600 rpm and a scan rate of 10 mV/s.

Catalyst durability is tested by a procedure defined by the U.S. Department of Energy for simulating a catalyst lifetime under Membrane Electrode Assembly (MEA) conditions, modified for use with a thin catalyst layer supported on an RDE under half-cell conditions. Specifically, the electrode is cycled from 0.6 to 1.0 V at 50 mV/s in a 0.1 M $HClO_4$ solution, left open to the air for up to 30,000 cycles. The ESA and specific activity are measured incrementally every 5,000 cycles.

FIG. 49 illustrates polarization curves obtained in oxygen saturated 0.1 M $HClO_4$ for (1) the $Pd_9Au$ nanowires compared with (2) monometallic palladium nanowires. FIG. 49 indicates that the $Pd_9Au$ nanowires maintain enhanced activity as compared with monometallic palladium nanowires. Inset to FIG. 49 is a plot of the potential (E) versus the surface area normalized kinetic currents ($J_K$) for (3) the monometallic palladium nanowires and (4) the $Pd_9Au$ nanowires. The inset to FIG. 49 indicates that activity of palladium active sites of (3) the $Pd_9Au$ nanowires exceeds that of (4) the monometallic palladium nanowires over a range of operating potentials.

FIG. 50 illustrates kinetic currents at 0.9 V normalized to the ESA to determine activity of palladium surface sites by comparison of: (1) $Pd_9Au$; (2) gold modified palladium nanowires by GD; (3) gold modified palladium nanowires by Cu UPD/GD; (4) commercial palladium nanowires and (5) platinum nanoparticles supported on carbon (Pt NP/C). The $Pd_9Au$ nanowires display a specific activity ($J_K$) of 0.49±0.04 mA/cm$^2$, more than doubling the activity of the commercial palladium nanowires, which have a specific activity of 0.21±0.02 mA/cm$^2$. The $Pd_9Au$ nanowires also demonstrate a 2-fold improvement over the corresponding value measured for the Pt NP/C, which had a specific activity of 0.21 mA/cm$^2$. Thus, activities greater than the Pt NP/C were obtained with no discernible platinum loading, which is generally required for this level of activity.

Electrochemical performance of the $Pd_9Au$ nanowires was compared with the performance of monometallic palladium nanowires modified by a GD and a Cu UPD/GD protocol. Specifically, gold was deposited on surfaces of the monometallic palladium nanowires using Cu UPD/GD. Because the monometallic palladium nanowires and the $Pd_9Au$ nanowires maintain similar dimensions, crystallinity, and surface texture, the role of a gold additive is highlighted.

FIG. 48 indicates that the line (3) gold modified monometallic palladium nanowires with Pd—Au pair sites at the surface of the monometallic nanowire maintain $H_{ads}$ and oxide formation features similar to the line (2) monometallic palladium nanowires. Accordingly, the activity obtained for the gold modified palladium nanowires by GD and Cu UPD/GD shown in lines (3) and (2) of FIG. 50, respectively, indicate that there is minimal enhancement in ORR activity when compared with the line (4) commercial palladium nanowires. These results indicate that enhancement of the activity for the $Pd_9Au$ nanowires is likely due to a homogeneous alloyed structure, as opposed to merely the presence of bimetallic sites localized on the surface of the bimetallic nanowire. An advantage of the present invention provides alloy-type composition of the bimetallic nanowires with improved activity over monometallic nanowires.

Figure 51:
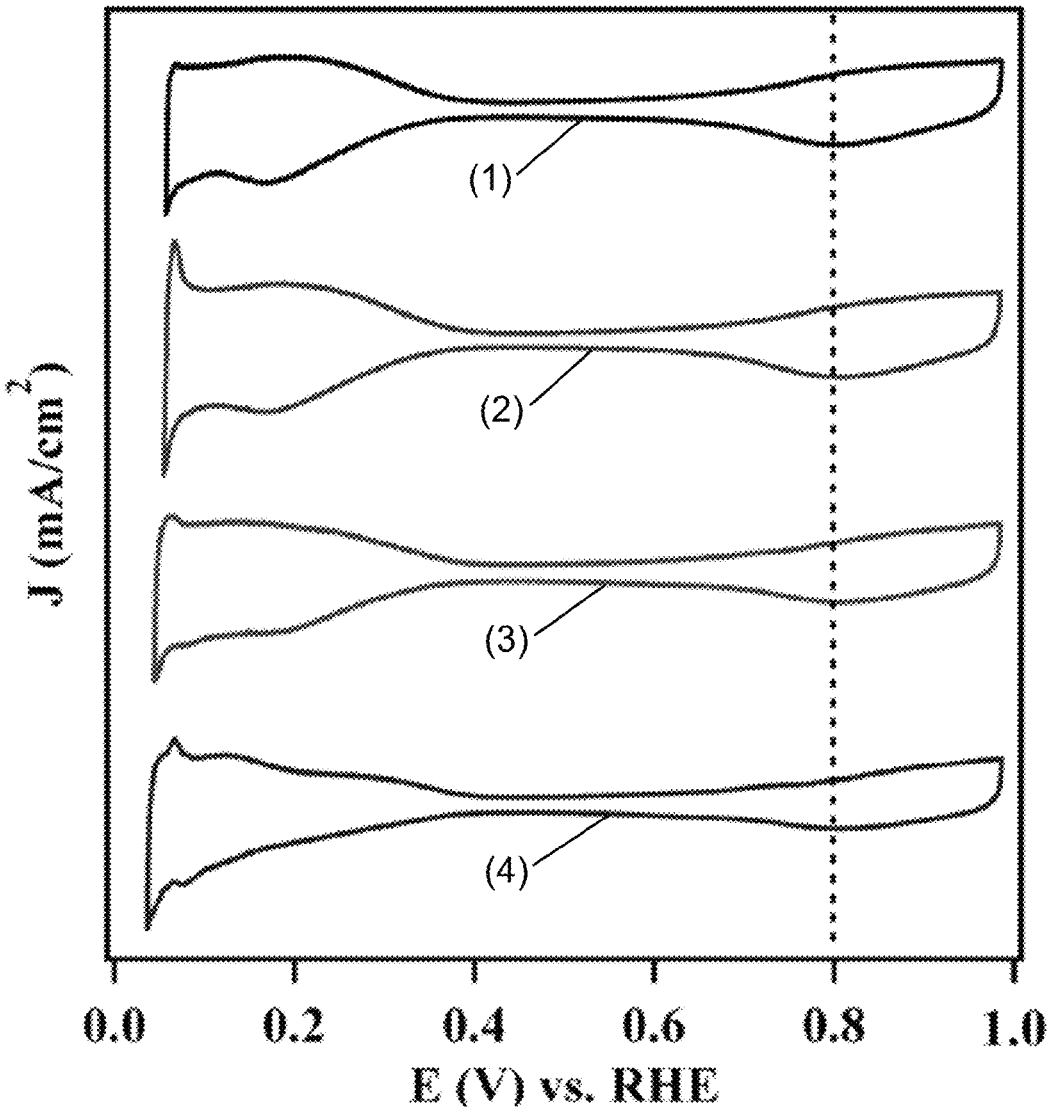
FIGS. 51-54 compare electrocatalytic performance of various nanowires.

FIGS. 51-54 are graphs comparing electrocatalytic performance of various nanowires. FIG. 51 illustrates cyclic voltammograms for $Pd_{1-x}Pt_x$ nanowires, including: (1) PdPt; (2) $Pd_7Pt_3$; and (3) $PdPt_4$ in comparison with (4) platinum nanowires. The current density (J, mA/cm$^2$) in FIG. 51 is calculated by normalizing the measured current to the ESA determined from the $H_{ads}$ charge and is shown as a function of the electrochemical potential (E) with respect to the Reversible Hydrogen Electrode (RHE). FIG. 51 indicates that there is a transition in $H_{ads}$ and oxide regions for lines (1), (2) and (3) when compared to line (4) as a percentage of platinum increased in the bimetallic nanowires.

Figure 52:
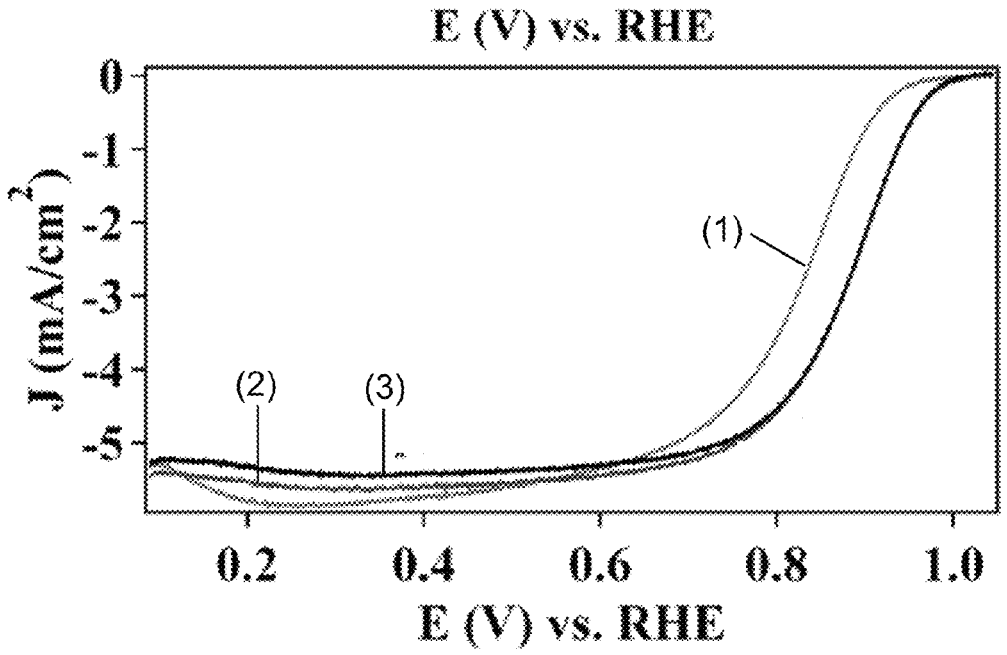
Figure 53:
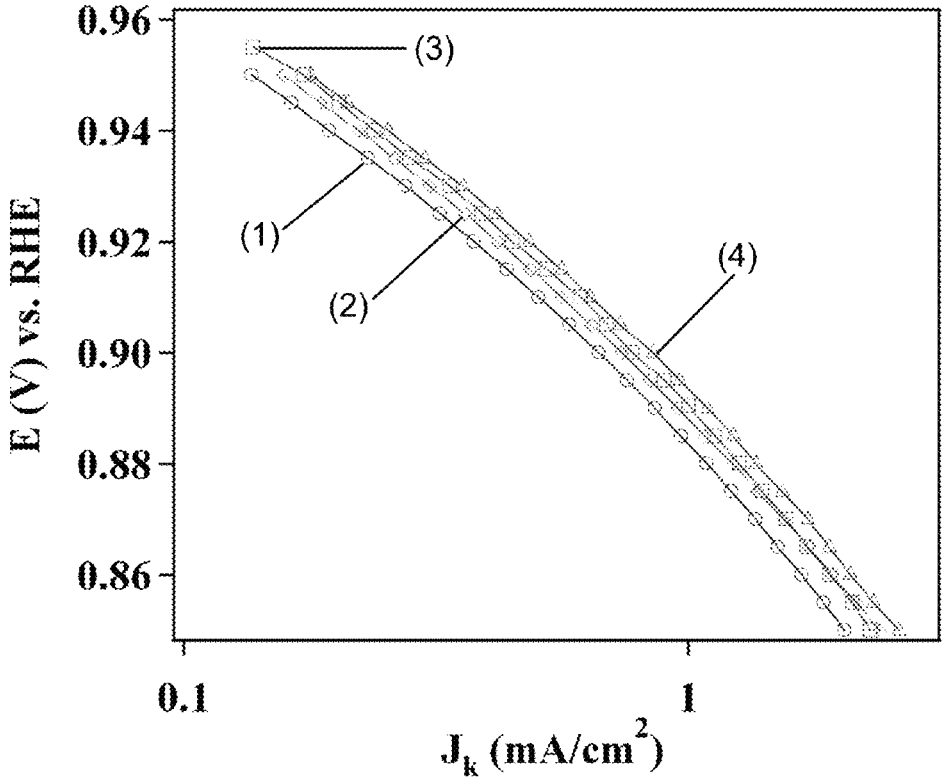
Figure 54:
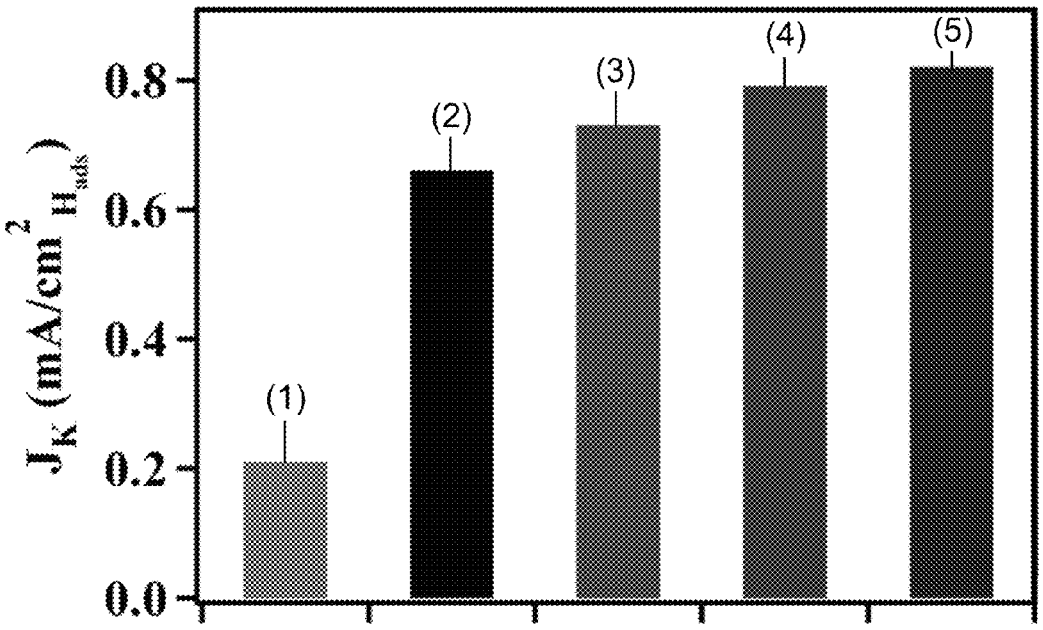

FIG. 52 illustrates polarization curves obtained for: (1) the monometallic palladium nanowires; (2) $PdPt_4$ nanowires; and (3) the monometallic platinum nanowires, taken at 1600 rpm in an anodic sweep direction. FIG. 53 is a graph of potential versus specific activity (E vs $J_K$) of the $Pd_{1-x}Pt_x$ nanowires including: (1) PtPd nanowires; (2) $Pt_7Pd_3$ nanowires; (3) $Pt_4Pd$; and (4) the monometallic platinum nanowires. FIG. 54 illustrates ESA activities, i.e. specific activities, for: (1) monometallic palladium nanowires; (2) PdPt nanowires; (3) $Pd_3Pt_7$; (4) $PdPt_4$; and (5) monometallic platinum nanowires. FIG. 54 indicates that the specific activity measured at 0.9 V increased from 0.64±0.01 to 0.79±0.01 mA/cm$^2$ as platinum content rises from 50% to 80%. This trend is further highlighted by the E vs $J_K$ curves shown in FIG. 53.

Thus, the activity of the $Pd_{1-x}Pt_x$ nanowires surpasses corresponding activity of both the commercial Pt NP/C (0.21 mA/cm$^2$) and the monometallic palladium nanowires (0.20 mA/cm$^2$). An unexpected finding is that activity of the PtPd nanowires of 0.64 mA/cm$^2$ exceeds that of Pt NP/C, while only having 50% platinum content.

Activity of the $PdPt_9$ nanowires of 0.79 mA/cm$^2$ is similar to the activity measured for monometallic platinum nanowires of 0.82±0.04 mA/cm$^2$ having approximately the same diameter. FIG. 52 supports this result, since FIG. 52 indicates that the $PdPt_4$ nanowires maintain activity similar to that of the monometallic platinum nanowires when the same percentage of metal is present on the electrode. Thus, activity trends for $Pd_{1-x}Pt_x$ nanowires indicated that a size-induced contraction phenomenon may be influenced by bimetallic nanowire diameter in addition to chemical composition.

Accordingly, the u-tube double diffusion vessel was employed as an ambient and surfactantless method to prepare bimetallic nanowires with control over composition, crystallinity, and spatial dimensions. The bimetallic nanowires provided herein display superior electrocatalytic performance as oxygen reduction catalysts as compared with commercial nanoparticles alone. Correlation between composition and electrochemical performance indicate advantages of the synthetic method since 1-D nanowires are generated with predictable structure and composition in an efficient manner.

While the invention has been shown and described with reference to certain embodiments of the present invention thereof, it will be understood by those skilled in the art that various changes in form and details may be made therein without departing from the spirit and scope of the present invention as defined by the appended claims and equivalents thereof.

What is claimed is:

1. A single crystalline bimetallic nanowire synthesis method, the method comprising:

adding first and second solutions into a vessel containing a porous template with the first solution containing first and second reagents added on one side of the porous template and the second solution added on an opposite side of the porous template, wherein the first reagent comprises a first salt of at least one of a transition metal, an actinide metal and a lanthanide metal, wherein the second reagent comprises a second salt of at least one of a transition metal, an actinide metal and a lanthanide metal, and wherein the second solution contains a reducing agent, wherein the single crystalline bimetallic nanowire is formed through an electroless deposition process.

2. The method of claim 1, wherein the synthesized single crystalline bimetallic nanowire is an alloy of the metal of the first salt and of the metal of the second salt, wherein the bimetallic nanowire has a stoichiometric composition described by: $A_{1-x}B_x$, where A is the metal of the first salt, B is the metal of the second salt, and x is $0<x<1$.

3. The method of claim 2, wherein the first salt comprises a metal cation of the metal of the first salt, with a corresponding anion comprising at least one of halides, oxides, acetates, acetyl-acetates, nitrates, phosphates, sulfates, sulfides, citrates, hydroxides, amine halides, amine hydroxides, hydrogen halides, alkali halides, ethylenediamine halides, hydrogen hydroxides, cyanides, and carbonates.

4. The method of claim 3, wherein the second salt comprises a metal cation of the metal of the second salt, with a corresponding anion comprising at least one of halides, oxides, acetates, acetyl-acetates, nitrates, phosphates, sulfates, sulfides, citrates, hydroxides, amine halides, amine hydroxides, hydrogen halides, alkali halides, ethylenediamine halides, hydrogen hydroxides, cyanides, and carbonates.

5. The method of claim 1, wherein the first solution and the second solution comprise at least one of an aqueous solvent and an alcoholic solvent, and mixtures thereof.

6. The method of claim 5, wherein the single crystalline bimetallic nanowire is synthesized with the solvent in a liquid state.

7. The method of claim 1, wherein the single crystalline bimetallic nanowire comprises at least two transition metals selected from the group consisting of palladium, gold and platinum.

* * * * *